US010202748B2

(12) United States Patent
Maeda et al.

(10) Patent No.: US 10,202,748 B2
(45) Date of Patent: Feb. 12, 2019

(54) SANITARY WASHING DEVICE AND TOILET APPARATUS

(71) Applicant: TOTO, Ltd., Kitakyushu-shi, Fukuoka (JP)

(72) Inventors: Masahiro Maeda, Kitakyushu (JP); Mitsunori Kai, Kitakyushu (JP)

(73) Assignee: TOTO, Ltd., Kitakyushu-shi, Fukuoka (JP)

( * ) Notice: Subject to any disclaimer, the term of this patent is extended or adjusted under 35 U.S.C. 154(b) by 21 days.

(21) Appl. No.: 15/223,190

(22) Filed: Jul. 29, 2016

(65) Prior Publication Data

US 2017/0030066 A1 Feb. 2, 2017

(30) Foreign Application Priority Data

Jul. 30, 2015 (JP) ..... 2015-150722

(51) Int. Cl.
*E03D 9/08* (2006.01)
*E03D 11/02* (2006.01)

(52) U.S. Cl.
CPC ..... *E03D 9/08* (2013.01); *E03D 11/02* (2013.01)

(58) Field of Classification Search
CPC ..... E03D 9/08
USPC ..... 4/420.1–420.5
See application file for complete search history.

(56) References Cited

U.S. PATENT DOCUMENTS 3,545,015 A * 12/1970 Richardson ..... A47K 13/24 4/420.2
4,550,454 A * 11/1985 Yui ..... E03D 9/08 239/461
5,666,672 A * 9/1997 Birsel ..... A47K 13/12 4/236
6,292,956 B1 * 9/2001 Kayahara ..... B28B 1/261 4/420
6,675,399 B1 * 1/2004 Tomita ..... E03D 3/00 4/420.2
7,036,159 B2 * 5/2006 Tomita ..... E03D 3/00 4/422
8,082,607 B2 * 12/2011 Matsushita ..... A47K 13/24 4/302
2014/0215703 A1 * 8/2014 Chuang ..... E03D 1/28 4/353

FOREIGN PATENT DOCUMENTS

EP 3064665 A1 * 9/2016 ..... E03D 9/08
JP 2014189999 A * 10/2014

* cited by examiner

*Primary Examiner* — Erin Deery
(74) *Attorney, Agent, or Firm* — Banner & Witcoff, Ltd.

(57) ABSTRACT

A sanitary washing device includes a body washing function unit, a casing, and a water supply connection unit. The body washing function unit includes a washing nozzle. The casing includes a base plate and a main body cover. The casing houses the body washing function unit in an enclosed space defined by the base plate and the main body cover. The water supply connection unit is provided in the enclosed space and has a connection port. The connection port is detachably connected to a water supply pipe. The casing has an opening at a bottom of the casing. The casing is configured such that the water supply pipe can be attached to and detached from the connection port. The connection port is disposed at a position accessible through the opening. The connection port is disposed at a position accessible from above when the main body cover is detached.

5 Claims, 12 Drawing Sheets

SANITARY WASHING DEVICE AND TOILET APPARATUS

CROSS-REFERENCE TO RELATED APPLICATIONS

This application is based upon and claims the benefit of priority from Japanese Patent Application No. 2015-150722, filed on Jul. 30, 2015; the entire contents of which are incorporated herein by reference.

FIELD

Embodiments of the invention relate to a sanitary washing device and a toilet apparatus including the sanitary washing device that use water to wash the "bottom" or the like of a user sitting on a western-style sit-down toilet.

BACKGROUND

A sanitary washing device includes a water supply connection unit detachably connected to a water supply pipe. In the sanitary washing device, for example, the water supply pipe (the water supply hose) that is flexible connects between a water supply source and the water supply connection unit. Thereby, the length of the water supply pipe can be modified easily according to the installation environment. By the water supply pipe being attachable and detachable, it is possible to replace only the water supply pipe and/or the water supply connection unit; and the ease of maintenance of the sanitary washing device can be increased.

In a conventional configuration, the water supply connection unit of the sanitary washing device is provided outside the sanitary washing device main body to easily connect the water supply pipe (Japanese Unexamined Patent Application Publication No. 2014-231704). However, in the case where the water supply connection unit is provided outside the main body, there is a risk of the water supply pipe detaching from the water supply connection unit and water leakage occurring due to erroneous contact by the user, etc. Therefore, a sanitary washing device has been described in which the water supply connection unit is provided at the bottom surface of the sanitary washing device main body and the water supply pipe is connected to the water supply connection unit at the product bottom surface (Japanese Unexamined Patent Application Publication No. 2015-68077).

Also, to improve the design quality in the sanitary washing device, it is desirable to use the sanitary washing device main body and the toilet to conceal the water supply connection unit.

However, in the case where the water supply connection unit that is provided at the bottom surface of the apparatus main body is concealed by the apparatus main body and the toilet, the water supply pipe unfortunately cannot be detached from the water supply connection unit after the sanitary washing device is mounted on the toilet without first detaching the sanitary washing device from the toilet. In other words, the replacement of the water supply pipe and/or the water supply connection unit is undesirably difficult.

Thus, the concealment of the water supply connection unit may reduce the ease of maintenance of the sanitary washing device. Therefore, in the sanitary washing device and in the toilet apparatus including the sanitary washing device, it is desirable to suppress the decrease of the ease of maintenance in the case where the water supply connection unit is concealed.

SUMMARY

According to one embodiment, a sanitary washing device includes a body washing function unit, a casing, and a water supply connection unit. The body washing function unit includes a washing nozzle. The body washing function unit washes a private part of a human body by squirting washing water toward the private part from the washing nozzle. The casing includes a base plate and a main body cover. The main body cover is detachably mounted on the base plate. The casing has an enclosed space defined by the base plate and the main body cover. The casing houses the body washing function unit in the enclosed space. The water supply connection unit is provided in the enclosed space and has a connection port. The connection port is detachably connected to a water supply pipe. The water supply connection unit supplies, to the body washing function unit, the washing water supplied from the water supply pipe. The casing has an opening at a bottom of the casing. The connection port is disposed in the enclosed space. The casing is configured such that the water supply pipe can be attached to and detached from the connection port. The connection port is disposed at a position accessible through the opening. The connection port is disposed at a position accessible from above when the main body cover is detached.

DETAILED DESCRIPTION

Figure 1:
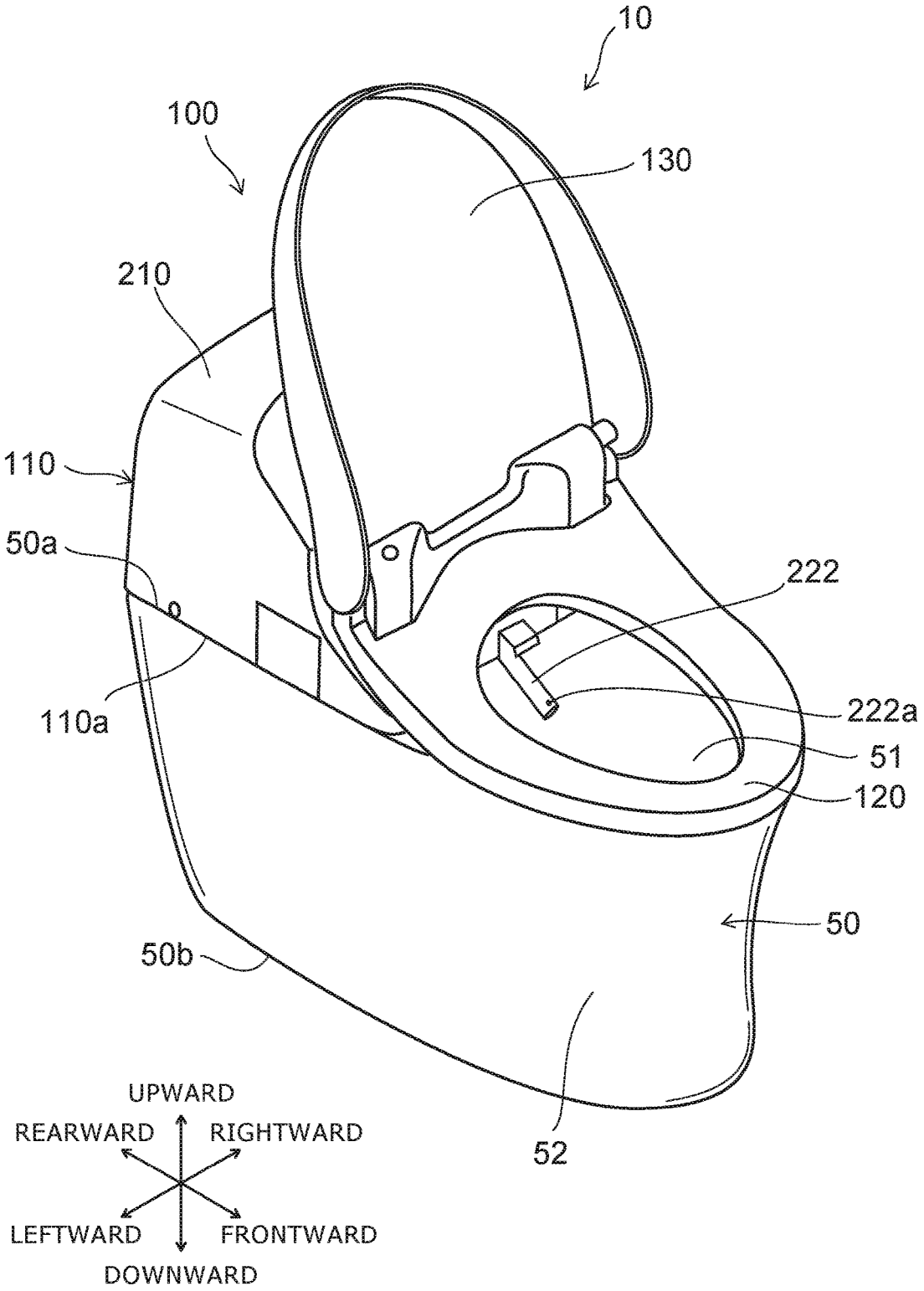
FIG. 1 is a perspective view schematically showing a toilet apparatus including a sanitary washing device according to an embodiment of the invention.

A first aspect of the invention is a sanitary washing device including a body washing function unit, a casing, and a water supply connection unit. The body washing function unit includes a washing nozzle. The body washing function unit washes a private part of a human body by squirting washing water toward the private part from the washing nozzle. The casing includes a base plate and a main body cover. The main body cover is detachably mounted on the base plate. The casing has an enclosed space defined by the base plate and the main body cover. The casing houses the body washing function unit in the enclosed space. The water supply connection unit is provided in the enclosed space and has a connection port. The connection port is detachably connected to a water supply pipe. The water supply connection unit supplies, to the body washing function unit, the washing water supplied from the water supply pipe. The casing has an opening at a bottom of the casing. The connection port is disposed in the enclosed space. The casing is configured such that the water supply pipe can be attached to and detached from the connection port. The connection port is disposed at a position accessible through the opening. The connection port is disposed at a position accessible from above when the main body cover is detached.

According to the sanitary washing device, the water supply connection unit and the connection port are disposed inside the casing; the casing is configured such that the water supply pipe can be attached to and removed from the connection port; the connection port is disposed at a position accessible through the opening; and the connection port is disposed at a position accessible from above when the main body cover is detached; therefore, even in the case where the water supply connection unit is concealed, it is unnecessary to detach the toilet and/or the sanitary washing device itself; and the replacement of the water supply pipe and/or the water supply connection unit, etc., can be performed merely by detaching the main body cover. Accordingly, in the sanitary washing device, the decrease of the ease of maintenance in the case where the water supply connection unit is concealed can be suppressed.

A second aspect of the invention is a sanitary washing device according to the first aspect of the invention, further including an upper cover and a retaining member. The upper cover is detachably mounted on the base plate. The upper cover covers an upper side of the connection port. The retaining member is detachably mounted on the water supply connection unit and the water supply pipe. The retaining member has a pair of clamping parts clamping the water supply connection unit and the water supply pipe. The water supply pipe has an insertion part inserted into the connection port. The retaining member is configured to suppress the insertion part from detaching from the connection port. The upper cover has a guide part that causes the retaining member to be disposed at a predetermined position and in a predetermined direction.

According to the sanitary washing device, mistaken mounting of the retaining member can be suppressed because the guide part of the upper cover causes the retaining member to be disposed at the predetermined position and in the predetermined direction. For example, the retaining member can be mounted appropriately on the water supply connection unit and the water supply pipe even if the operator is inexperienced.

A third aspect of the invention is a sanitary washing device according to the second aspect of the invention, wherein the water supply connection unit has a first cylindrical part and a first flange part. The first flange part has the connection port at an end of the first flange part. The first flange part is adjacent to the end of the first cylindrical part. An outside diameter of the first flange part is larger than an outside diameter of the first cylindrical part. The water supply pipe has a second flange part and a second cylindrical part. The second flange part is provided at a back end of the insertion part and comes into contact with the first flange part when the insertion part is inserted into the connection port. The second cylindrical part is adjacent to the second flange part. An outside diameter of the second cylindrical part is smaller than an outside diameter of the second flange part. At least a part of the retaining member has elasticity. The retaining member is configured such that the elastic deformation of the retaining member allows the pair of clamping parts to move closer to or away from each other. The guide part allows the retaining member to be mounted on the water supply connection unit and the water supply pipe in a first state which is a state in which the pair of clamping parts clamps the first cylindrical part and the second cylindrical part, while the guide part does not allow the retaining member to be mounted on the water supply connection unit and the water supply pipe in a second state which is a state in which the pair of clamping parts clamps the first flange part and the second flange part such that a distance between the clamping parts in the second state is wider than a distance between the clamping parts in the first state.

According to the sanitary washing device, the undesirable connection of the retaining member to the water supply connection unit and the water supply pipe when the pair of clamping parts clamps the first flange part and the second flange part can be suppressed. The mistaken mounting of the retaining member can be suppressed more appropriately.

A fourth aspect of the invention is a sanitary washing device according to the second aspect of the invention, wherein the guide part has a concave portion and houses at least tips of the clamping parts in the concave portion when the retaining member is mounted on the water supply connection unit and the water supply pipe. The concave portion has a first width in a first direction, where the first direction is a coaxial direction of the water supply connection unit and the water supply pipe. The tips of the clamping parts have a second width in the first direction. The first width is 1.0-1.5 times the second width.

According to the sanitary washing device, the undesirable mounting of the retaining member obliquely to the water supply connection unit and the connection pipe can be suppressed. The mistaken mounting of the retaining member can be suppressed more appropriately.

A fifth aspect of the invention is a sanitary washing device according to the first aspect of the invention, further including a lower cover and a retaining member. The lower cover is detachably mounted on the base plate, and covers a part of the opening. The lower cover is disposed at a position accessible from below. The retaining member is detachably mounted on the water supply connection unit and the water supply pipe. The retaining member has a pair of clamping parts clamping the water supply connection unit and the water supply pipe. The water supply connection unit has the connection port above the part of the opening. The water supply pipe has an insertion part inserted into the connection port. The retaining member is configured to suppress the insertion part from detaching from the connection port. The lower cover has a facing surface facing the retaining member when the lower cover is mounted on the base plate. The lower cover comes into contact with the retaining member and moves the retaining member toward an appropriate position when the pair of clamping parts clamps the water supply connection unit and the water supply pipe at a position lower than the appropriate position.

According to the sanitary washing device, if the clamping parts of the retaining member clamp the water supply connection unit and the water supply pipe at a position lower than the appropriate position, the facing surface of the lower cover comes into contact with the retaining member and moves the retaining member toward the appropriate position; therefore, the half-inserted state of the retaining member can be eliminated. For example, the retaining member can be mounted appropriately to the water supply connection unit and the water supply pipe even if the operator is inexperienced.

A sixth aspect of the invention is a toilet apparatus including a toilet and a sanitary washing device. The toilet has an upper surface. The sanitary washing device is provided on the upper surface of the toilet. The sanitary washing device includes a body washing function unit, a casing, and a water supply connection unit. The body washing function unit includes a washing nozzle. The body washing function unit washes a private part of a human body by squirting washing water toward the private part from the washing nozzle. The casing includes a base plate and a main body cover. The main body cover is detachably mounted on the base plate. The casing has an enclosed space defined by the base plate and the main body cover. The casing houses the body washing function unit in the enclosed space. The water supply connection unit is provided in the enclosed space and has a connection port. The connection port is detachably connected to a water supply pipe. The water supply connection unit supplies, to the body washing function unit, the washing water supplied from the water supply pipe. The casing has a bottom surface facing the upper surface and has an opening at a bottom of the casing. The connection port is disposed in the enclosed space. The casing is configured such that the water supply pipe can be attached to and detached from the connection port. The connection port is disposed at a position accessible through the opening. The connection port is disposed at a position accessible from above when the main body cover is detached. The toilet has the upper surface disposed under the entire bottom surface of the casing.

According to the toilet apparatus, the water supply connection unit and the connection port are disposed inside the casing; the water supply pipe can be attached to and removed from the connection port from below through the opening; and the water supply pipe can be attached to and removed from the connection port from above when the main body cover is detached; therefore, even in the case where the water supply connection unit is concealed, it is unnecessary to detach the toilet and/or the sanitary washing device itself; and the replacement of the water supply pipe and/or the water supply connection unit, etc., can be performed by merely detaching the main body cover. Accordingly, in the sanitary washing device, the decrease of the ease of maintenance in the case where the water supply connection unit is concealed can be suppressed.

Embodiments of the invention will now be described with reference to the drawings. Similar constituents in the drawings are marked with the same reference numerals; and a detailed description is omitted as appropriate.

FIG. 1 is a perspective view schematically showing a toilet apparatus including a sanitary washing device according to an embodiment of the invention.

As shown in FIG. 1, the toilet apparatus 10 includes a western-style sit-down toilet (for convenience of description hereinbelow, called simply the "toilet") 50, and a sanitary washing device 100 provided on the western-style sit-down toilet 50. The sanitary washing device 100 includes a casing 110, a toilet seat 120, and a toilet lid 130. The toilet seat 120 and the toilet lid 130 each are pivotally supported openably and closeably by the casing 110.

Here, in this specification, "above" as viewed by a user sitting on the toilet seat 120 is taken as "upward;" and "below" as viewed by the user sitting on the toilet seat 120 is taken as "downward." The "front" as viewed by the user sitting on the toilet seat 120 with the back of the user facing the toilet lid 130 in the open state is taken as "frontward;" and the "rear" as viewed by the user sitting on the toilet seat 120 is taken as "rearward." The right side as viewed by the user standing in front of the toilet 50 facing rearward is taken as "rightward;" and the left side as viewed by the user standing in front of the toilet 50 facing rearward is taken as "leftward."

The toilet 50 has an upper surface 50*a*. The upper surface 50*a* is, for example, a plane substantially parallel to the floor surface when the toilet 50 is placed on the floor surface of the toilet space. The upper surface 50*a* may be tilted with respect to the floor surface and may have multiple surfaces having different heights from the floor surface.

The toilet 50 also includes a bowl 51. The bowl 51 has a concave portion that recesses downward from the upper surface 50*a*. The bowl 51 of the toilet 50 receives excrements such as urine, feces, etc., of the user. The bowl 51 is connected to a not-shown drain trap pipe line. The bowl 51 is connected to a drainage pipe via the drain trap pipe line, a drain socket, etc., and flushes the excrement, etc., through the drainage pipe. The bowl 51 and the drain trap pipe line are formed to collect a prescribed amount of water inside the bowl 51 when not in use.

The bowl 51 is disposed toward the front of the upper surface 50*a*. The casing 110 of the sanitary washing device 100 is placed on a portion of the upper surface 50*a* rearward of the bowl 51. Thus, the casing 110 is placed on the toilet 50 rearward of the bowl 51. In other words, the upper surface 50*a* includes a placement region for placing the casing 110 of the sanitary washing device 100 rearward of the bowl 51.

For example, the toilet 50 is made of a ceramic or porcelain. The material of the toilet 50 may be a resin, etc. For example, the toilet 50 may be formed of a combination of a ceramic or porcelain and a resin.

Figure 2:
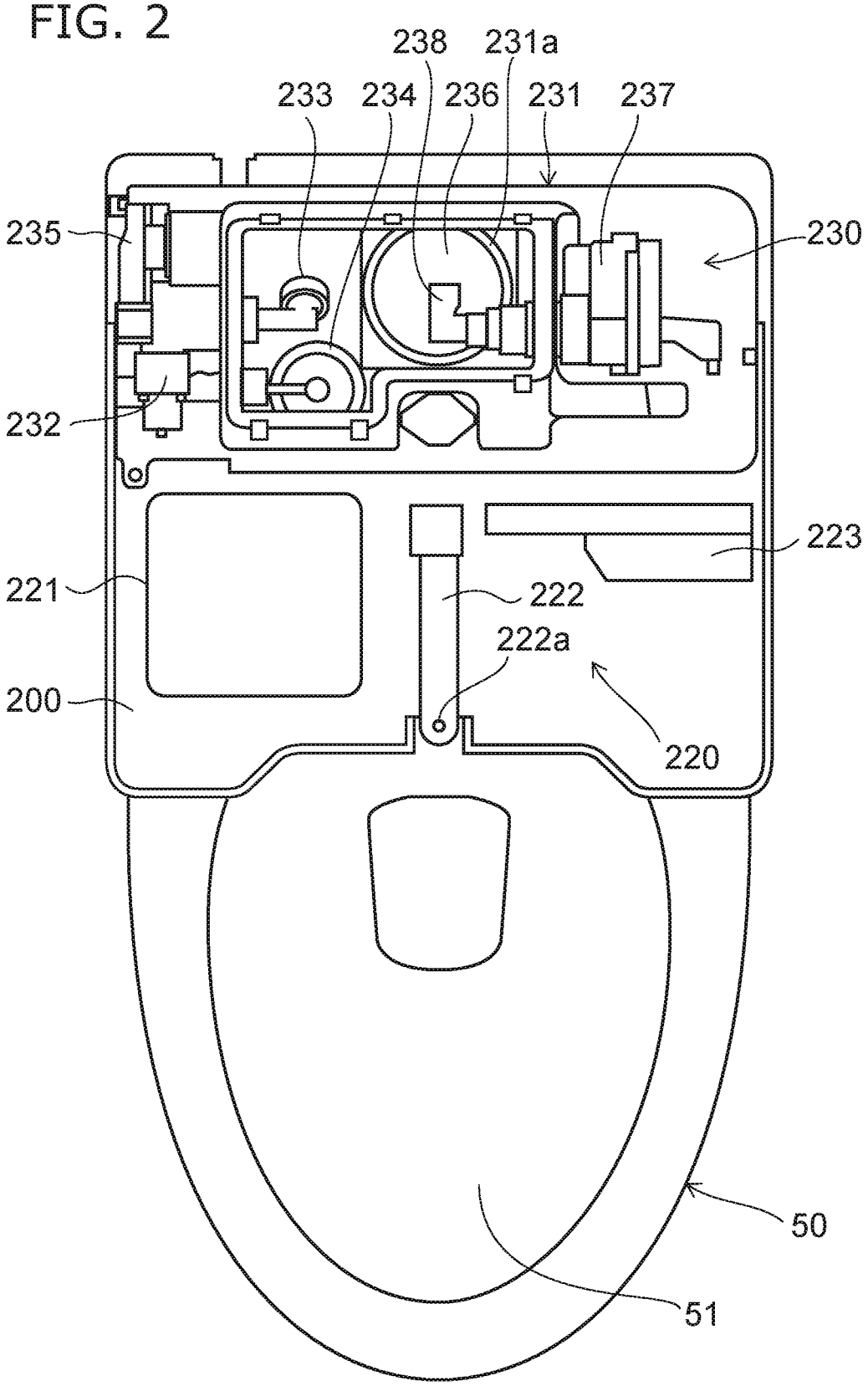
FIG. 2 is a plan view schematically showing the internal structure of the main body unit of the sanitary washing device according to the embodiment of the invention.

FIG. 2 is a plan view schematically showing the internal structure of the main body unit of the sanitary washing device according to the embodiment of the invention.

As shown in FIG. 1 and FIG. 2, the casing 110 of the sanitary washing device 100 includes a base plate 200 and a main body cover 210. The sanitary washing device 100 further includes a body washing function unit 220 and a toilet washing function unit 230. The casing 110 has an enclosed space defined by the base plate 200 and the main body cover 210; and the casing 110 houses the body washing function unit 220 and the toilet washing function unit 230 in the enclosed space.

The casing 110 has a bottom surface 110*a* that faces the upper surface 50*a* of the toilet 50. The bottom surface 110*a* is, for example, the bottom surface of the base plate 200. The upper surface 50*a* of the toilet 50 is disposed under the entire bottom surface 110*a* of the casing 110. Thereby, a gap between the toilet 50 and the casing 110 is suppressed. Accordingly, in the toilet apparatus 10, the interior of the casing 110 cannot be accessed from below after the sanitary washing device 100 is mounted on the toilet 50. The width in the lateral direction of the casing 110 is, for example, substantially the same as the width in the lateral direction of the placement region of the upper surface 50*a*. The casing 110 is substantially coplanar with the toilet 50 in the lateral direction.

The body washing function unit 220 and the toilet washing function unit 230 are provided on the base plate 200. The main body cover 210 is provided on the base plate 200 and covers the functional units of the interior such as the body washing function unit 220, the toilet washing function unit 230, etc. The main body cover 210 is detachably mounted on the base plate 200. In FIG. 2, some of the members of the main body cover 210, etc., are not shown for convenience.

The body washing function unit 220 performs a body wash of washing the "bottom," etc., of the user sitting on the toilet seat 120. The toilet washing function unit 230 performs a toilet wash of flushing the excrement, etc., through the drainage pipe by causing water to flow in the bowl 51 and by replacing the water collected in the bowl 51. The sanitary washing device 100 includes, for example, an operation unit such as a not-shown remote control, etc. The body washing function unit 220 and the toilet washing function unit 230 respectively perform the body wash and the toilet wash according to the operation of an operation unit by the user.

The body washing function unit 220 includes, for example, a heater 221, a washing nozzle 222, and a controller 223.

The heater 221 heats the water supplied from the water supply source to a prescribed temperature. In this specification, "water" refers not only to cold water but also includes hot water that is heated. The heater 221 includes, for example, a stored-hot-water heat exchanger. The heater 221 may be an instantaneously-heating (instantaneous type) heat exchanger including a ceramic heater, etc. The heater 221 is not limited to a heat exchanger and may include, for example, a heater that utilizes microwave heating or the like, or a heater of another heating method.

The heater 221 is connected to the controller 223. For example, the controller 223 heats the water to the temperature set by the operation unit by controlling the heater 221 according to the operation of the operation unit by the user.

The washing nozzle 222 moves to a position extended inside the bowl 51 of the toilet 50 and to a position stored inside the main body cover 210. The retraction movement of the washing nozzle 222 is controlled by the controller 223. A water discharge port 222*a* is provided in the tip of the washing nozzle 222. The washing nozzle 222 is provided on the downstream side of the heater 221 and squirts the water heated by the heater 221 from the water discharge port 222*a*.

The controller 223 operates the heater 221 according to a body wash instruction from the operation unit and heats the water supplied from the water supply source. Then, the controller 223 causes the washing nozzle 222 to extend inside the bowl 51 and squirts the heated water toward a private part of a human body such as the "bottom," etc., of the user sitting on the toilet seat 120. Thereby, the private part of the user is washed by the body washing function unit 220.

The toilet washing function unit 230 includes, for example, a washing water tank 231, a water supply valve 232, a water discharge port 233, a float 234, an intake 235, a drain valve 236, and a drive unit 237.

The washing water tank 231 stores the water for performing the toilet wash in the interior of the washing water tank 231. The washing water tank 231 includes a lid to seal the washing water tank 231 from above and suppresses the outflow of vapor of the stored water to the outside. The state in which the lid of the washing water tank 231 is detached is shown in FIG. 2 for easier illustration of the water discharge port 233, the float 234, the drain valve 236, etc.

The water supply valve 232 switches between water discharge and water shutoff for the washing water supplied from the water supply source into the washing water tank 231. The water discharge port 233 is provided downstream of the water supply valve 232. The water discharge port 233 opens into the washing water tank 231 and discharges the washing water from the water supply valve 232 into the washing water tank 231. The float 234 is provided inside the washing water tank 231 and ascends and descends according to the water level inside the washing water tank 231.

When the water level inside the washing water tank 231 decreases and the float 234 descends to a prescribed water level, the water supply valve 232 opens; and the discharge of the washing water from the water discharge port 233 into the washing water tank 231 is started. Then, when the water level inside the washing water tank 231 rises and the float 234 becomes higher than a prescribed water level, the water supply valve 232 closes; and the water discharge port 233 is shutoff. Thereby, the washing water inside the washing water tank 231 is adjusted to be a prescribed amount.

The intake 235 assists the supply water of the washing water into the washing water tank 231 and the drainage of the washing water from the washing water tank 231 by introducing the ambient air into the washing water tank 231.

A drainage port 231*a* is provided at the bottom part of the washing water tank 231. The drain valve 236 closes the drainage port 231*a*. The drive unit 237 moves the drain valve 236 to a position that closes the drainage port 231*a* and a position that opens the drainage port 231*a* by transferring a drive force to the drain valve 236 via a transmission mechanism 238.

According to a toilet wash instruction from the operation unit, the drive unit 237 opens the drain valve 236 for a prescribed amount of time and closes the drain valve 236 after the prescribed amount of time has elapsed. Thereby, according to the toilet wash instruction from the user, a constant amount of washing water is supplied to the toilet 50 from the washing water tank 231; and the bowl 51 of the toilet 50 is washed.

A tank-type toilet washing function unit 230 is shown in the example in which the washing water is collected in the washing water tank 231. The toilet washing function unit 230 may be, for example, a service water direct pressure-type in which the washing water supplied from the water supply source is directly supplied to the toilet 50, etc. In the example, the sanitary washing device 100 also includes the toilet washing function unit 230. The toilet washing function unit 230 is provided in the sanitary washing device 100 as necessary and is omissible. For example, the toilet washing function unit 230 may be provided in the toilet apparatus 10 separately from the sanitary washing device 100.

Figure 3A:
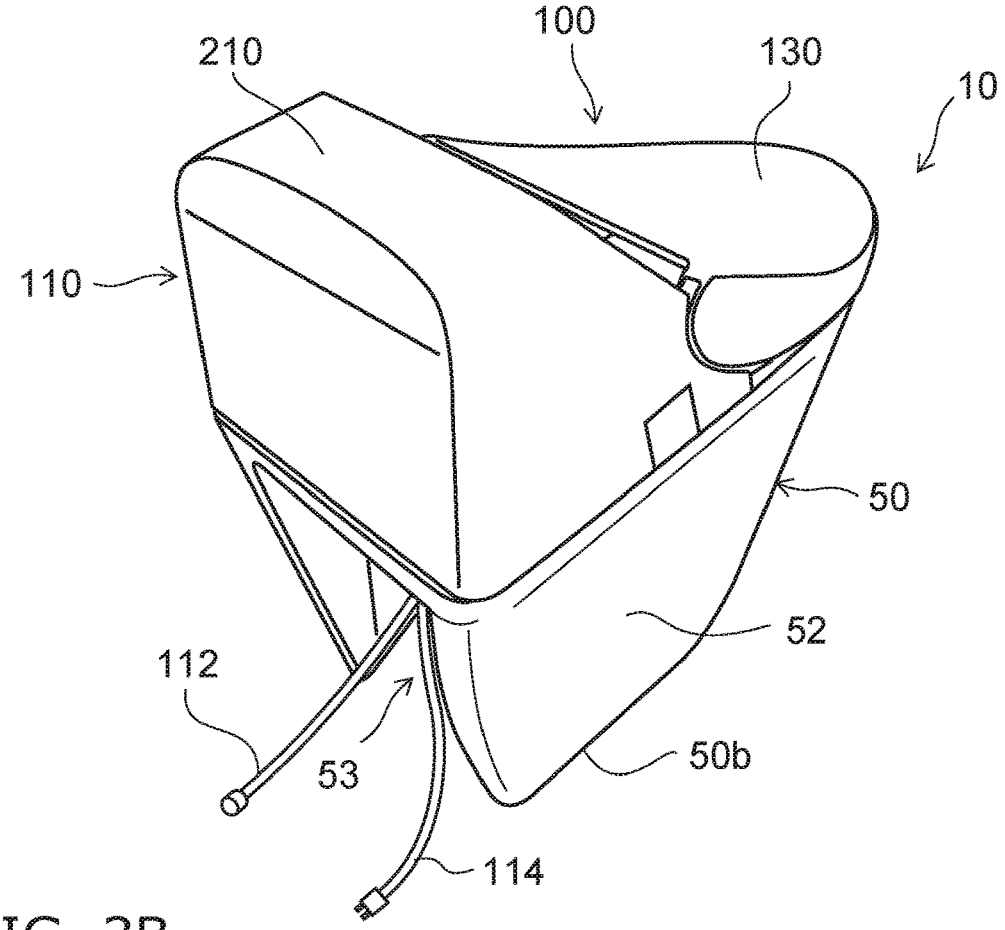
FIGS. 3A and 3B are perspective views schematically showing the toilet apparatus including the sanitary washing device according to the embodiment of the invention.
Figure 3B:
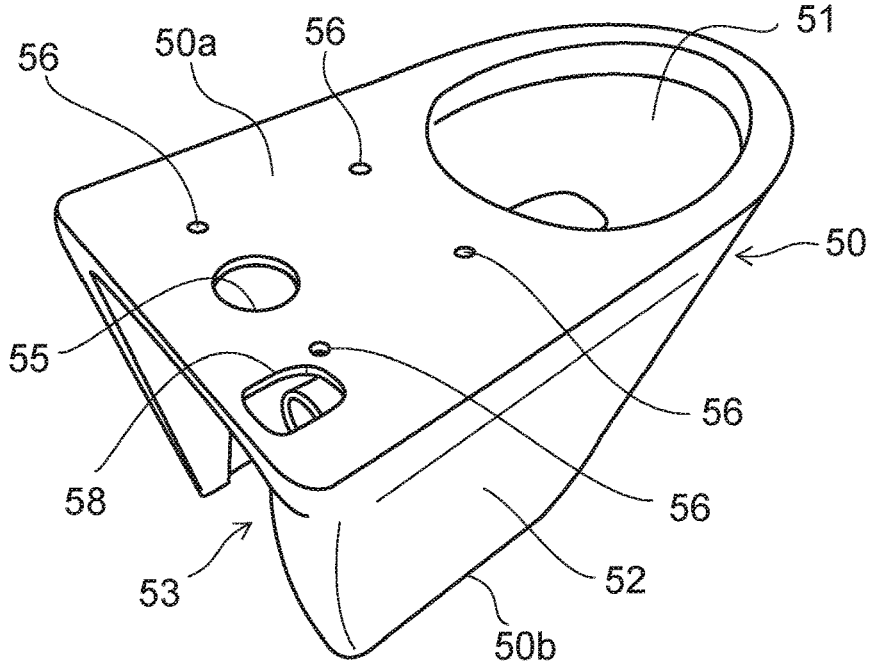

FIG. 3A and FIG. 3B are perspective views schematically showing the toilet apparatus including the sanitary washing device according to the embodiment of the invention.

FIG. 3A is a perspective view of the toilet apparatus 10 as viewed from the rearward side.

FIG. 3B is a perspective view of only the toilet 50 as viewed from the rearward side.

As shown in FIG. 3A and FIG. 3B, the toilet 50 includes a side surface part 52 and a recess 53. The side surface part 52 is the portion that connects between the upper surface 50*a* and a bottom surface 50*b* of the toilet 50. The side surface part 52 surrounds the two sides and front of the upper surface 50*a* and the bottom surface 50*b*. Thus, the two sides and front of the toilet 50 are covered with a continuous surface. Only the side surface part 52 of the toilet 50 is exposed when the toilet 50 is viewed from the two sides and the front.

The recess 53 is formed to face rearward. Thus, the toilet 50 has a configuration in which a portion is hollowed out from the rear toward the front. However, as described above, when viewed from the two sides and the front, the recess 53 is covered with the side surface part 52 and is not exposed to the outside.

A communicating hole 55, multiple mounting holes 56, and an opening 58 are provided in the upper surface 50*a* of the toilet 50. The communicating hole 55 is provided at a position facing the drainage port 231*a* of the washing water tank 231 when the sanitary washing device 100 is placed on the upper surface 50*a*. The communicating hole 55 communicates with a not-shown waterway. The waterway is a pipe line that connects between the communicating hole 55 and the bowl 51. Thereby, the washing water that is discharged from the washing water tank 231 is supplied to the bowl 51 via the drainage port 231*a*, the communicating hole 55, and the waterway.

The mounting holes 56 are through-holes that reach the recess 53 from the upper surface 50*a*. The mounting holes 56 are used to mount the sanitary washing device 100. The sanitary washing device 100 is mounted on the toilet 50 by inserting fasteners such as screws, etc., through the mounting holes 56 after placing the sanitary washing device 100 on the upper surface 50*a* and by clamping a part of the toilet 50 between a bottom surface 200*a* of the base plate 200 and the fasteners. The mounting of the sanitary washing device 100 to the toilet 50 is performed with the base plate 200 interposed. Thereby, the main body cover 210 can be detached when the sanitary washing device 100 is mounted on the base plate 200. Four mounting holes 56 are shown in the example. The number of mounting holes 56 may be arbitrary. There may be one mounting hole 56.

The opening 58 exposes a part of the recess 53 upward. The recess 53 is covered with the side surface part 52 at the front and two sides; and other than the portion at the opening 58, the recess 53 is covered with the upper surface 50*a* from above. The opening 58 is, for example, a through-hole that is continuous with the recess 53 from the upper surface 50*a*. The opening 58 is disposed toward the rear of the upper surface 50*a*. The opening 58 may be, for example, a notch that extends frontward from the rear end of the upper surface 50*a*.

As shown in FIG. 3A, a water supply pipe 112 and a power supply line 114 are connected to the sanitary washing device 100. One end of the water supply pipe 112 is connected to the sanitary washing device 100; and the other end of the water supply pipe 112 is connected to the water supply source. Thereby, the washing water is supplied to the sanitary washing device 100 via the water supply pipe 112. The water supply pipe 112 is detachably connected to the sanitary washing device 100 and the water supply source. Thereby, it is easy to replace the water supply pipe 112; and the ease of maintenance of the sanitary washing device 100 is better. For example, the water supply pipe 112 that has the appropriate length is selected for the toilet apparatus 10 when installing in the toilet space. In the case where the length of the water supply pipe 112 is insufficient, etc., the water supply pipe 112 is replaced in the installation operation. The water supply pipe 112 is flexible. The water supply pipe 112 includes, for example, a rubber hose, a flexible metal hose, etc.

One end of the power supply line 114 is connected to the sanitary washing device 100; and the other end of the power supply line 114 is connected to an electrical power supply source such as a commercial power source, etc. (e.g., a plug socket provided in a wall surface). Thereby, electrical power is supplied to the sanitary washing device 100 via the power supply line 114. The power supply line 114 is detachably connected to the electrical power supply source. The power supply line 114 can be attached to and detached from the sanitary washing device 100 or may be fixed to the sanitary washing device 100.

When mounting the sanitary washing device 100, the water supply pipe 112 and the power supply line 114 are inserted through the opening 58 and are drawn out to the outside from the toilet 50 from the recess 53 as shown in FIG. 3A.

Figure 4:
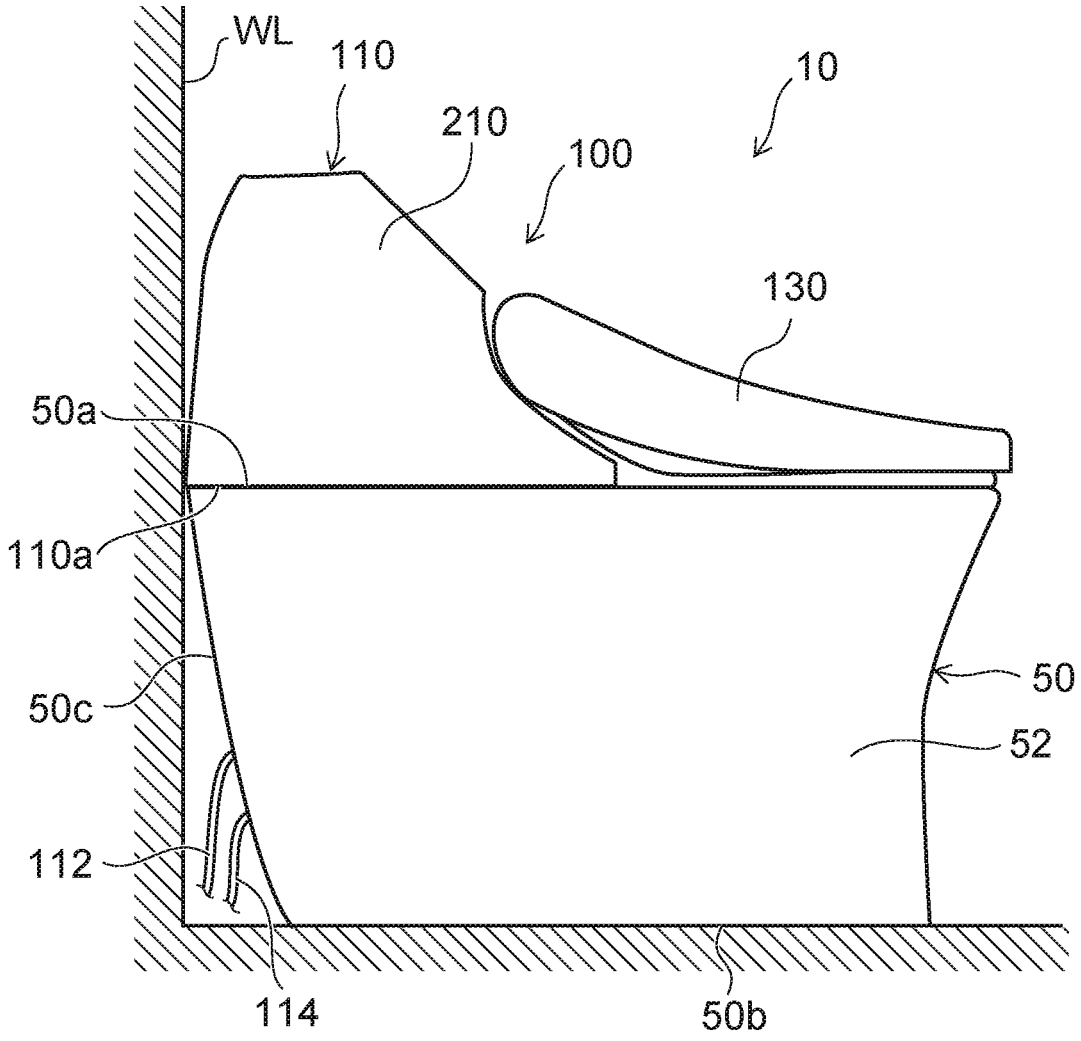
FIG. 4 is a side view schematically showing the toilet apparatus including the sanitary washing device according to the embodiment of the invention.

FIG. 4 is a side view schematically showing the toilet apparatus including the sanitary washing device according to the embodiment of the invention.

As shown in FIG. 4, for example, the toilet 50 is installed so that a rear end part 50*c* is proximal to a wall surface WL in the toilet space. For example, the toilet 50 is installed in the toilet space in the state in which a portion of the rear end part 50*c* is in contact with the wall surface WL in the toilet space. Here, the rear end part 50*c* is the rear end of the exterior configuration of the toilet 50 when the toilet 50 is viewed from the side. In other words, the rear end part 50*c* is the rear end of the side surface part 52.

The rear end of the bottom surface 50*b* is positioned frontward of the rear end of the upper surface 50*a*. The rear end part 50*c* is tilted toward the front side from the upper surface 50*a* toward the bottom surface 50*b*. Thereby, even in the case where the upper surface 50*a* vicinity of the rear end part 50*c* contacts the wall surface WL, there is a gap between the wall surface WL and the bottom surface 50*b* vicinity of the rear end part 50*c*. As shown in FIG. 4, the water supply pipe 112 and the power supply line 114 are drawn out from the recess 53 and are drawn out from the gap between the rear end part 50*c* and the wall surface WL.

Thus, in the toilet apparatus 10, the connection unit (the water supply connection unit) between the water supply pipe 112 and the sanitary washing device 100 and the connection unit (the power supply connection unit) between the power supply line 114 and the sanitary washing device 100 are concealed by the toilet 50, the casing 110, and the wall surface WL. In the toilet apparatus 10, the water supply connection unit and the power supply connection unit (hereinbelow, collectively called the "water/power supply unit") are covered with and hidden by the casing 110 and the toilet 50 themselves. Thereby, in the toilet apparatus 10, the design quality can be improved compared to a toilet apparatus in which the water/power supply unit is exposed to the outside, a toilet apparatus in which the water/power supply unit is hidden by covering with a cover or the like, etc.

Figure 5A:
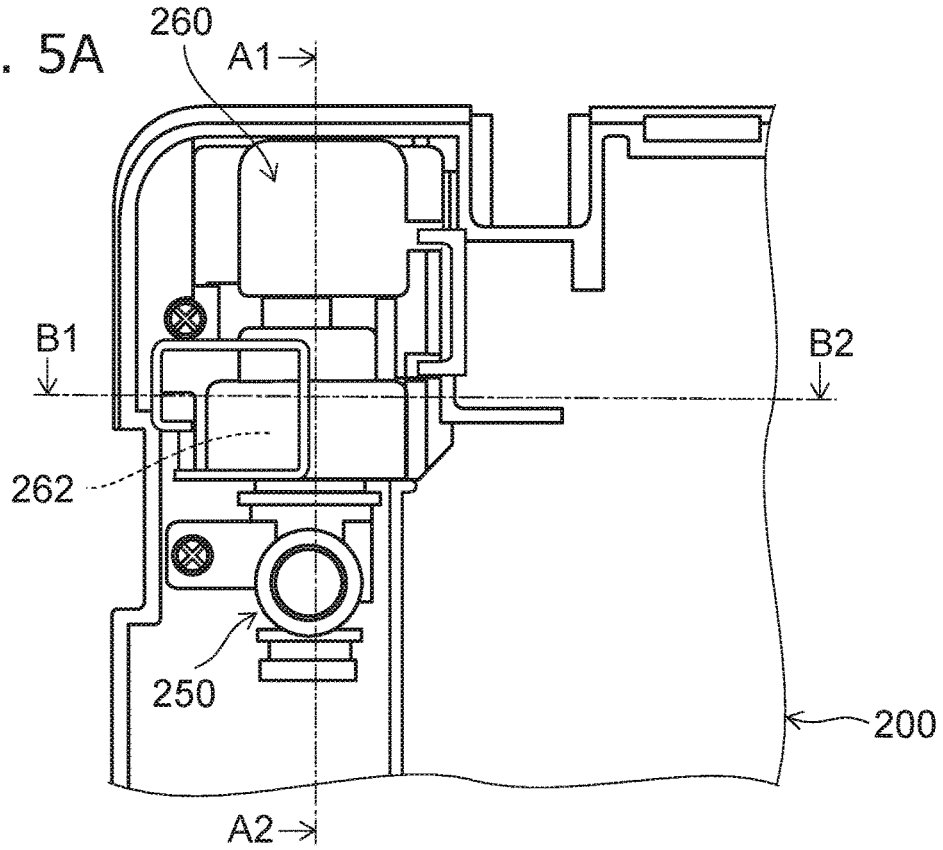
FIGS. 5A and 5B are plan views schematically showing a part of the sanitary washing device according to the embodiment of the invention.
Figure 5B:
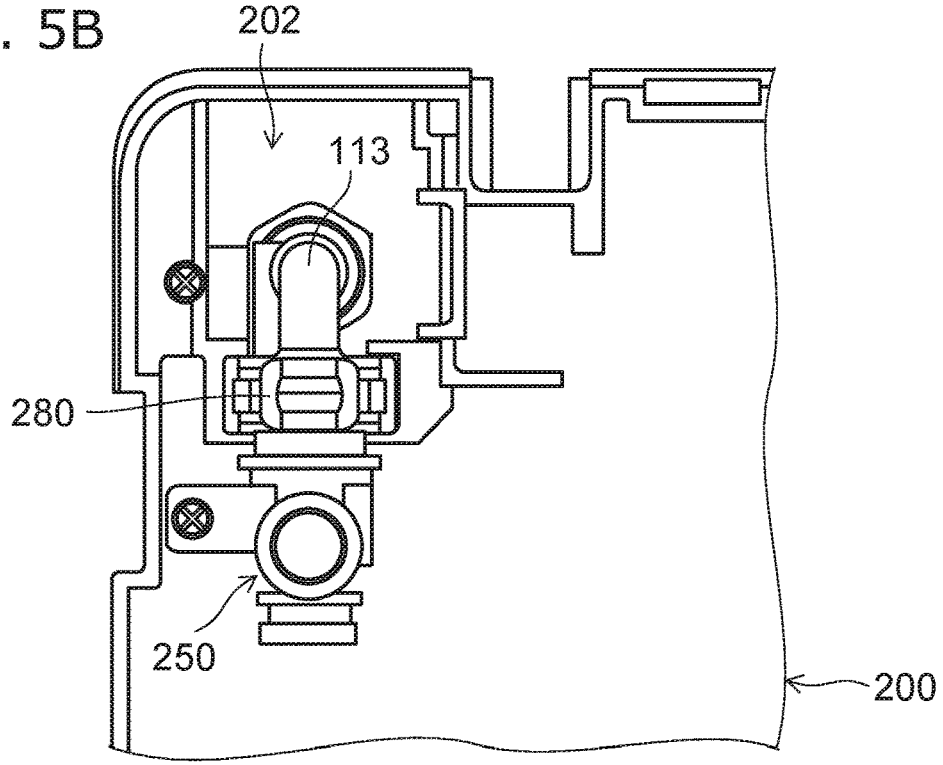

FIG. 5A and FIG. 5B are plan views schematically showing a part of the sanitary washing device according to the embodiment of the invention.

Figure 6:
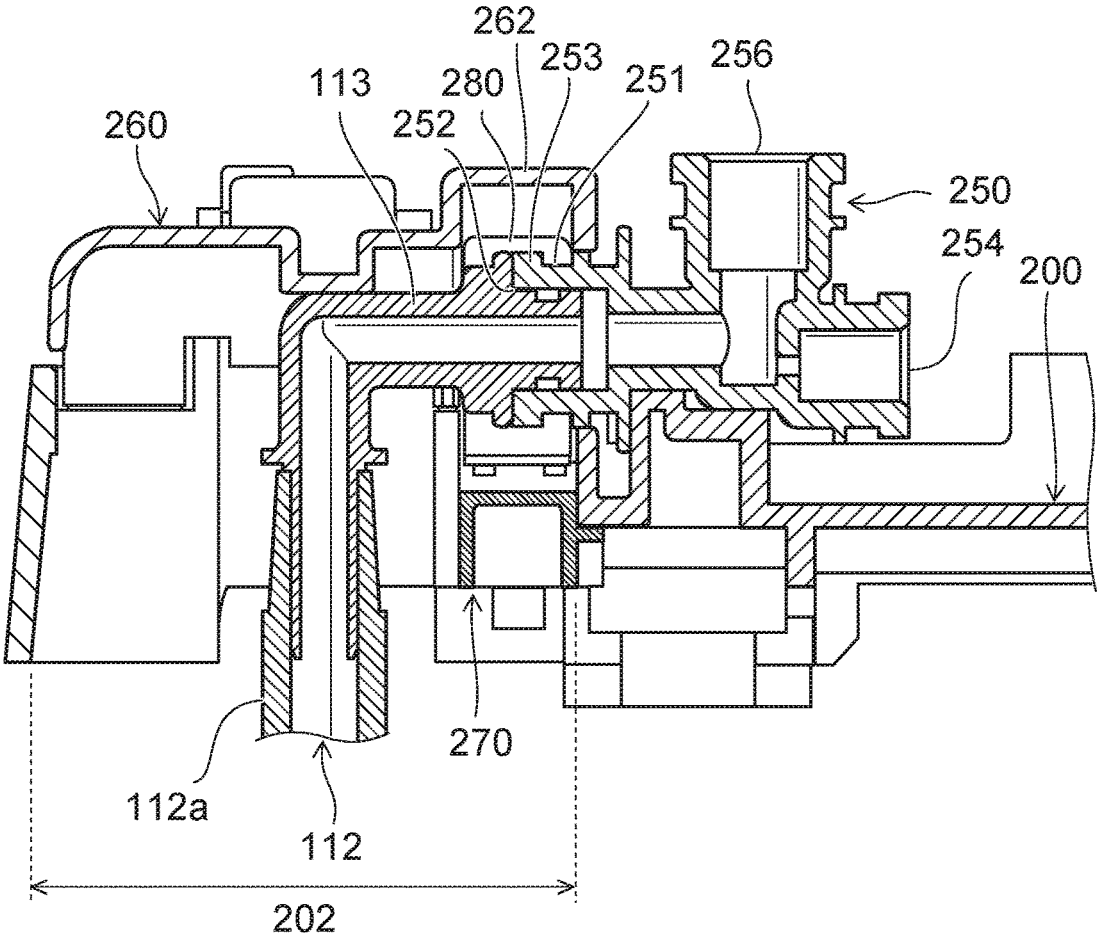
FIG. 6 is a cross-sectional view schematically showing a part of the sanitary washing device according to the embodiment of the invention.

FIG. 6 is a cross-sectional view schematically showing a part of the sanitary washing device according to the embodiment of the invention.

FIG. 6 schematically shows a line A1-A2 cross section of FIG. 5A.

As shown in FIG. 5A, FIG. 5B, and FIG. 6, the sanitary washing device 100 further includes a water supply connection unit 250, an upper cover 260, and a lower cover 270. However, the state in which the upper cover 260 is detached is shown in FIG. 5B for convenience.

The water supply connection unit 250 has a cylindrical part 251 (a first cylindrical part), and a connection port 252 detachably connected to the water supply pipe 112. The connection port 252 is, for example, a substantially circular opening provided at one end of the cylindrical part 251. The water supply connection unit 250 is provided on the base plate 200. In other words, the water supply connection unit 250 is provided inside the enclosed space defined by the base plate 200 and the main body cover 210. The connection port 252 of the water supply connection unit 250 is disposed inside the enclosed space defined by the base plate 200 and the main body cover 210. For example, the connection port 252 of the water supply connection unit 250 faces a direction orthogonal to the vertical direction. In the example, the connection port 252 faces rearward. The direction in which the connection port 252 faces is not limited thereto and may be any direction.

The base plate 200 has an opening 202. The opening 202 is provided to be positioned above the opening 58 of the toilet 50 when the sanitary washing device 100 is mounted on the toilet 50. In other words, the opening 202 exposes a part of the recess 53 above the base plate 200 through the opening 58.

Thus, the casing 110 has the opening 202 that faces downward. The opening 202 is used when inserting the water supply pipe 112 and the power supply line 114 through the opening 202. The water supply pipe 112 and the power supply line 114 enter the enclosed space inside the casing 110 through the opening 202. In the example, the opening 202 is a through-hole provided in the base plate 200. The opening 202 is not limited thereto and may be, for example, a gap between the base plate 200 and the main body cover 210, etc.

The water supply connection unit 250 is mounted on the base plate 200 proximally to the opening 202. The cylindrical part 251 of the water supply connection unit 250 extends above the opening 202; and the connection port 252 is disposed above the opening 202.

The water supply connection unit 250 further has connection ports 254 and 256. The connection port 254 is used to connect to the body washing function unit 220. For example, the connection port 254 is connected to the heater 221 via a pipe, a solenoid valve, etc. The connection port 256 is used to connect to the toilet washing function unit 230. For example, the connection port 256 is connected to the water supply valve 232 via a pipe, etc.

In the example, the water supply connection unit 250 is a so-called Y-branch pipe. The connection port 256 is omissible in the case where the sanitary washing device 100 does not include the toilet washing function unit 230. It is sufficient for the water supply connection unit 250 to be a pipe line that has at least the connection port 252 for connecting the water supply pipe 112 and the connection port 254 for connecting to the body washing function unit 220.

The water supply pipe 112 includes a main body unit 112*a* and a connection pipe 113. The connection pipe 113 is connected to one end of the main body unit 112*a*. In other words, the connection pipe 113 is provided at one end of the water supply pipe 112. The connection pipe 113 includes a material that is harder than that of the main body unit 112*a* of the water supply pipe 112 such as, for example, a metal, a resin, etc. The connection pipe 113 is bent into a substantially L-shaped configuration. The water supply pipe 112 is connected to the water supply connection unit 250 by inserting a portion of the connection pipe 113 into the connection port 252 of the water supply connection unit 250. Thereby, the washing water is supplied to the body washing function unit 220 and the toilet washing function unit 230 via the water supply pipe 112 and the water supply connection unit 250.

The upper cover 260 is mounted on the base plate 200 and covers the upper side of the connection port 252. In other words, the upper cover 260 covers the connection portion between the water supply connection unit 250 and the water supply pipe 112. The upper cover 260 also covers at least a part of the opening 202 of the base plate 200. In the example, the upper cover 260 covers substantially the entire opening 202. Thereby, for example, the upper cover 260 suppresses the undesirable entrance of hands and fingers of an operator, etc., into the casing 110 through the opening 202. For example, an electric shock due to contacting the power supply unit or the like is suppressed. For example, the upper cover 260 is detachably mounted on the base plate 200 by mounting members such as screws, etc.

The lower cover 270 is mounted on the base plate 200, covers a part of the opening 202, and is disposed at a position accessible from below. For example, the water supply connection unit 250 has the connection port 252 above the part of the opening 202 covered with the lower cover 270. The lower cover 270 is detachably mounted on the base plate 200.

The casing 110 is configured such that the water supply pipe 112 can be attached to and detached from the connection port 252 of the water supply connection unit 250; the connection port 252 is disposed at a position accessible through the opening 202; and the connection port 252 is disposed at a position accessible from below when the lower cover 270 is detached. The water supply pipe 112 can be attached to and detached from the connection port 252 of the water supply connection unit 250; and the connection port 252 is disposed at a position accessible from above when the main body cover 210 and the upper cover 260 are detached.

Figure 7A:
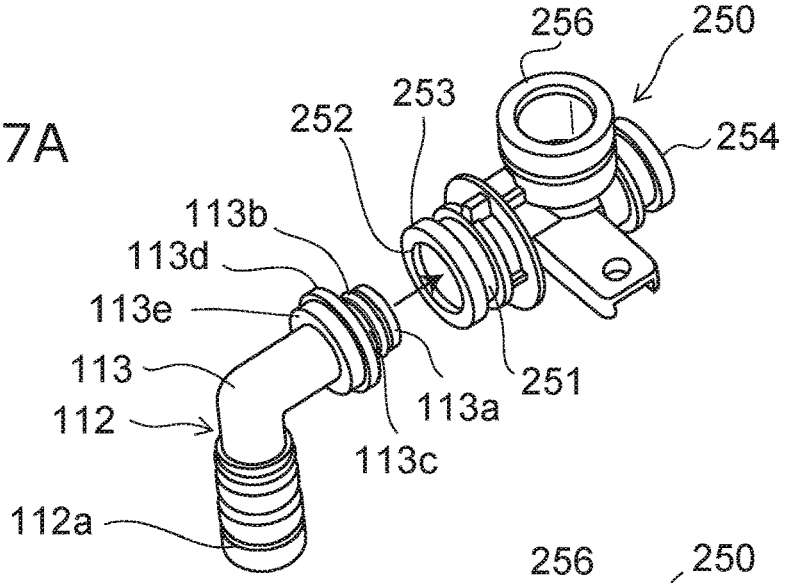
FIGS. 7A to 7C are perspective views schematically showing a part of the sanitary washing device according to the embodiment of the invention.
Figure 7B:
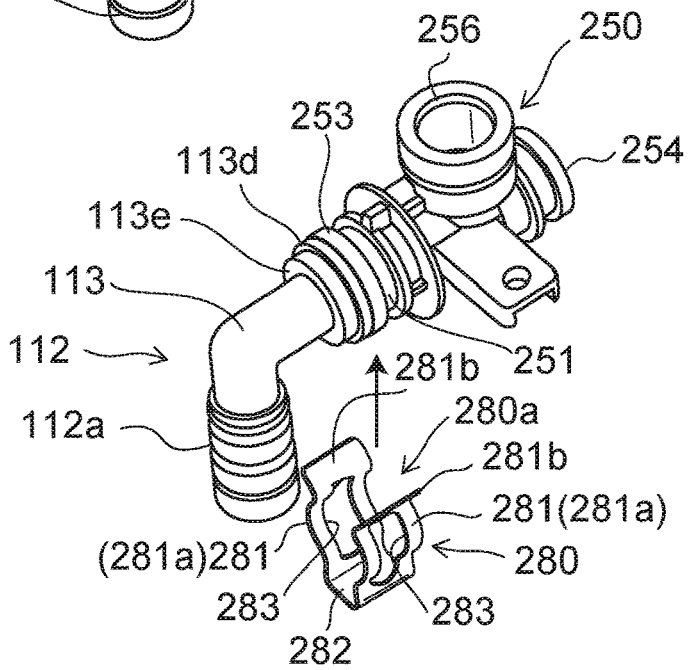
Figure 7C:
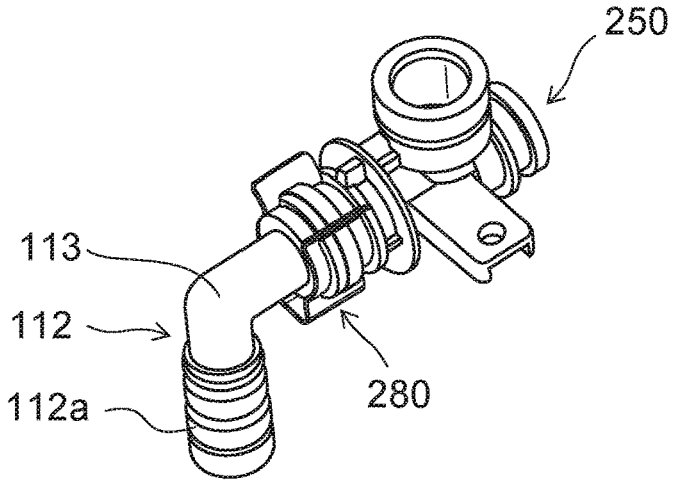

FIG. 7A to FIG. 7C are perspective views schematically showing a part of the sanitary washing device according to the embodiment of the invention.

As shown in FIG. 7A, the connection pipe 113 of the water supply pipe 112 includes an insertion part 113*a* that is inserted into the connection port 252 of the water supply connection unit 250. The exterior configuration of the insertion part 113*a* corresponds to the configuration of the connection port 252. For example, the insertion part 113*a* has a cylindrical configuration. The outside diameter of the insertion part 113*a* is substantially the same as the inside diameter of the connection port 252.

A groove 113*b* is provided in the outer circumferential surface of the insertion part 113*a*. A sealing member 113*c* is provided in the groove 113*b*. The sealing member 113*c* is made of an elastic material such as rubber, etc., and fills the gap between the insertion part 113*a* and the water supply connection unit 250. Thereby, water leakage at the connection portion between the water supply pipe 112 and the water supply connection unit 250 are suppressed. Although the connection pipe 113 is inserted into the connection port 252 in the configuration of the example, for example, conversely, a configuration may be used in which the connection port 252 is inserted into the connection pipe 113.

A flange part 253 (a first flange part) is provided in the cylindrical part 251 of the water supply connection unit 250. The flange part 253 is adjacent to the tip of the cylindrical part 251. The outside diameter of the flange part 253 is larger than the outside diameter of the cylindrical part 251. Thus, the flange part 253 is a portion at the tip of the cylindrical part 251 that has a large outside diameter.

The connection pipe 113 further has a flange part 113*d* (a second flange part) and a cylindrical part 113*e* (a second cylindrical part). The flange part 113*d* is adjacent to the insertion part 113*a* and comes into contact with the flange part 253 of the water supply connection unit 250 when the insertion part 113*a* is inserted into the connection port 252. The cylindrical part 113*e* is adjacent to the flange part 113*d*. The outside diameter of the cylindrical part 113*e* is smaller than the outside diameter of the flange part 113*d*. The outside diameter of the flange part 113*d* is substantially the same as the outside diameter of the flange part 253. The outside diameter of the cylindrical part 113*e* is substantially the same as the outside diameter of the cylindrical part 251 of the water supply connection unit 250.

As shown in FIG. 7B, a retaining member 280 is used to connect the water supply pipe 112 and the water supply connection unit 250. The retaining member 280 has a pair of clamping parts 281 clamping the water supply pipe 112 and the water supply connection unit 250. The retaining member 280 includes a material that is elastic such as a metal, a resin, etc. The retaining member 280 is configured such that the elastic deformation of the retaining member 280 allows the clamping parts 281 to move closer to or away from each other. In the example, the entire retaining member 280 is elastic. This is not limited thereto; and it is sufficient for at least a part of the retaining member 280 to have elasticity and for the retaining member 280 to be configured such that the elastic deformation of the retaining member 280 allows the clamping parts 281 to move closer to or away from each other.

The clamping parts 281 each include a curved part 281*a* that is curved according to the outside diameter of the cylindrical part 251 and the outside diameter of the cylindrical part 113*e*. The clamping parts 281 clamp the water supply pipe 112 and the water supply connection unit 250 at the parts of the curved parts 281*a*. Thereby, the water supply pipe 112 and the water supply connection unit 250 can be clamped more appropriately. Also, the clamping parts 281 can primarily determine the position where the water supply pipe 112 and the water supply connection unit 250 are clamped.

The retaining member 280 includes a connection unit 282 and a pair of openings 283. The connection unit 282 connects ends of the clamping parts 281 to each other. Accordingly, the end parts of the clamping parts 281 on the side opposite to the connection unit 282 are used as an opening end 280*a*. The water supply pipe 112 and the water supply connection unit 250 are inserted into the clamping parts 281 from the opening end 280*a*.

The connection unit 282 is separated from the water supply pipe 112 and the water supply connection unit 250 when the clamping parts 281 clamp the water supply pipe 112 and the water supply connection unit 250 at the parts of the curved parts 281*a*. The connection unit 282 makes it easy to detach the retaining member 280 because it is possible to insert a tool, etc., into the gap formed between the water supply connection unit 250 and the connection unit 282.

The openings 283 are provided in the curved parts 281*a* of the clamping parts 281. The width of each opening 283 is substantially the same as the total length of the width of the flange part 253 and the width of the flange part 113*d*.

As shown in FIG. 7C, the retaining member 280 is mounted on the water supply connection unit 250 and the connection pipe 113 after inserting the insertion part 113*a* of the connection pipe 113 into the connection port 252. The retaining member 280 is mounted on the water supply connection unit 250 and the connection pipe 113 from a direction orthogonal to the direction in which the connection port 252 faces. For example, the retaining member 280 is mounted on the water supply connection unit 250 and the connection pipe 113 from the upward direction or the downward direction.

The retaining member 280 clamps the cylindrical part 251 of the water supply connection unit 250 and the cylindrical part 113*e* of the connection pipe 113 with the clamping parts 281; and a part of the flange parts 253 and 113*d* is caused to enter the openings 283. Thereby, the retaining member 280 causes the water supply connection unit 250 and the connection pipe 113 to engage in the direction in which the connection pipe 113 detaches from the connection port 252, and suppresses the connection pipe 113 from detaching from the connection port 252. The retaining member 280 is a so-called quick fastener.

Tips 281*b* of the clamping parts 281 are tilted in directions away from the curved parts 281*a* to widen the opening end 280*a*. Thereby, the retaining member 280 can be mounted easily to the water supply connection unit 250 and the connection pipe 113. The tips 281*b* guide the water supply connection unit 250 and the connection pipe 113 into the curved parts 281*a*.

When the clamping parts 281 clamp the cylindrical parts 251 and 113*e*, the retaining member 280 is rotatable with the cylindrical parts 251 and 113*e* as an axis. By providing the curved parts 281*a* in the clamping parts 281, the retaining member 280 can rotate more easily at this time. For example, the detachment of the retaining member 280 due to the rotation can be suppressed.

Figure 8:
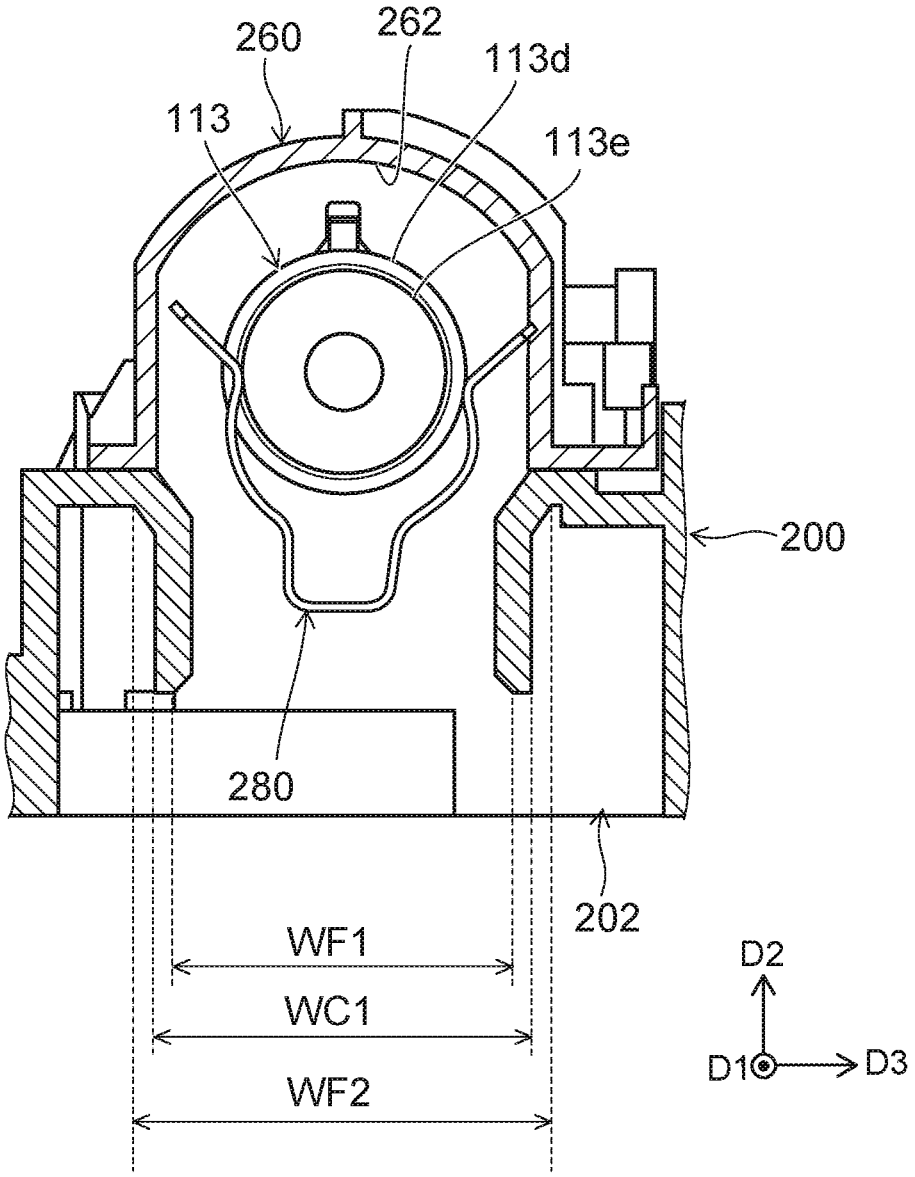
FIG. 8 is a cross-sectional view schematically showing a part of the sanitary washing device according to the embodiment of the invention.

FIG. 8 is a cross-sectional view schematically showing a part of the sanitary washing device according to the embodiment of the invention.

FIG. 8 schematically shows a line B1-B2 cross section of FIG. 5A.

As shown in FIG. 8, the upper cover 260 has a guide part 262 that causes the retaining member 280 to be disposed at a predetermined position and in a predetermined direction. For example, the guide part 262 has a concave portion and houses at least the tips 281*b* of the retaining member 280 in the concave portion of the guide part 262. Here, a first direction D1 is the coaxial direction of the water supply connection unit 250 and the connection pipe 113. In other words, the first direction D1 is the direction in which the cylindrical part 251 extends. In the example, the first direction D1 is the frontward/rearward direction. A second direction D2 is the insertion/detachment direction of the retaining member 280 orthogonal to the first direction D1. In the example, the second direction D2 is the vertical direction. A third direction D3 is a direction orthogonal to the first direction D1 and the second direction D2. In the example, the third direction D3 is the lateral direction.

A width WC1 in the third direction D3 of the concave portion of the guide part 262 is wider than a maximum width WF1 in the third direction D3 of the retaining member 280 when the clamping parts 281 of the retaining member 280 clamp the cylindrical parts 251 and 113*e*.

On the other hand, the width WC1 in the third direction D3 of the guide part 262 is narrower than a maximum width WF2 in the third direction D3 of the retaining member 280 when the clamping parts 281 of the retaining member 280 clamp the flange parts 253 and 113*d*.

Thereby, the mounting of the retaining member 280 on the water supply connection unit 250 and the connection pipe 113 is allowed when the clamping parts 281 of the retaining member 280 appropriately clamp the cylindrical parts 251 and 113*e*. Conversely, when the clamping parts 281 clamp the flange parts 253 and 113*d*, the tips 281*b* of the retaining member 280 come into contact with the inner surface of the guide part 262 and do not allow the retaining member 280 to be mounted on the water supply connection unit 250 and the connection pipe 113.

Thus, in the first state in which the clamping parts 281 clamp the cylindrical parts 251 and 113*e*, the guide part 262 allows the retaining member 280 to be mounted on the water supply connection unit 250 and the water supply pipe 112; and in the second state in which the clamping parts 281 clamp the flange parts 253 and 113*d* such that the distance between the clamping parts 281 is wider than the distance between the clamping parts 281 in the first state, the guide part 262 comes into contact with the retaining member 280 and does not allow the retaining member 280 to be mounted on the water supply connection unit 250 and the water supply pipe 112. Thereby, mistaken mounting of the retaining member 280 can be suppressed.

Figure 9:
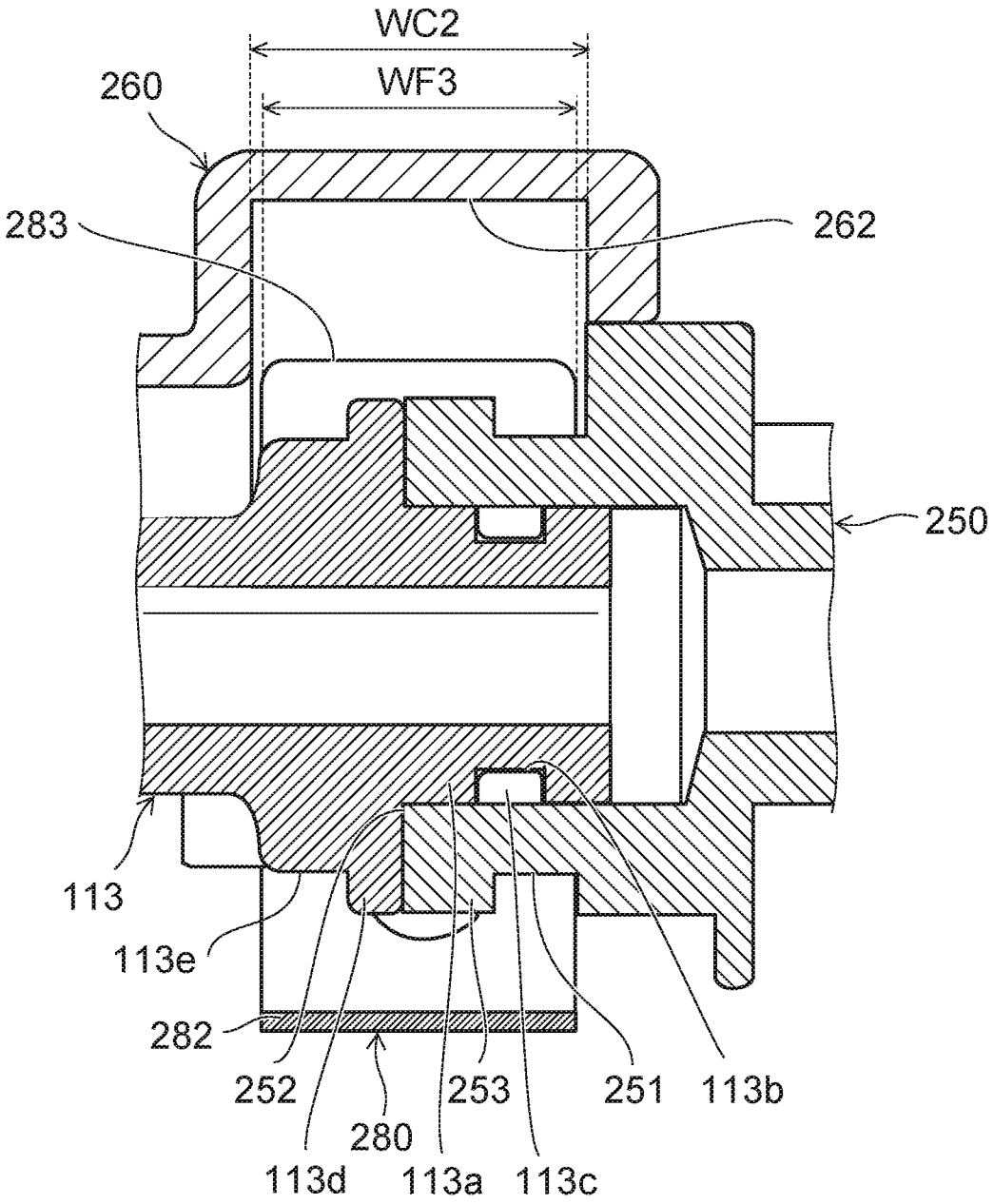
FIG. 9 is a cross-sectional view schematically showing a part of the sanitary washing device according to the embodiment of the invention.

FIG. 9 is a cross-sectional view schematically showing a part of the sanitary washing device according to the embodiment of the invention.

As shown in FIG. 9, a width WC2 in the first direction D1 of the concave portion of the guide part 262 is set to be about the same as a width WF3 in the first direction D1 of the retaining member 280. The width WC2 (first width) is, for example, not less than 1 times and not more than 1.5 times the width WF3 (second width). More favorably, the width WC2 is, for example, not less than 1 times and not more than 1.3 times the width WF3. Thereby, the undesirable mounting of the retaining member 280 obliquely to the water supply connection unit 250 and the connection pipe 113 can be suppressed. The mistaken mounting of the retaining member 280 can be suppressed further.

Thus, by the guide part 262 causing the retaining member 280 to be disposed at the predetermined position and in the predetermined direction, the upper cover 260 suppresses the mistaken mounting of the retaining member 280 to the water supply connection unit 250 and the connection pipe 113. Thereby, the occurrence of water leakage, etc., due to the mistaken mounting of the retaining member 280 can be suppressed.

Figure 10A:
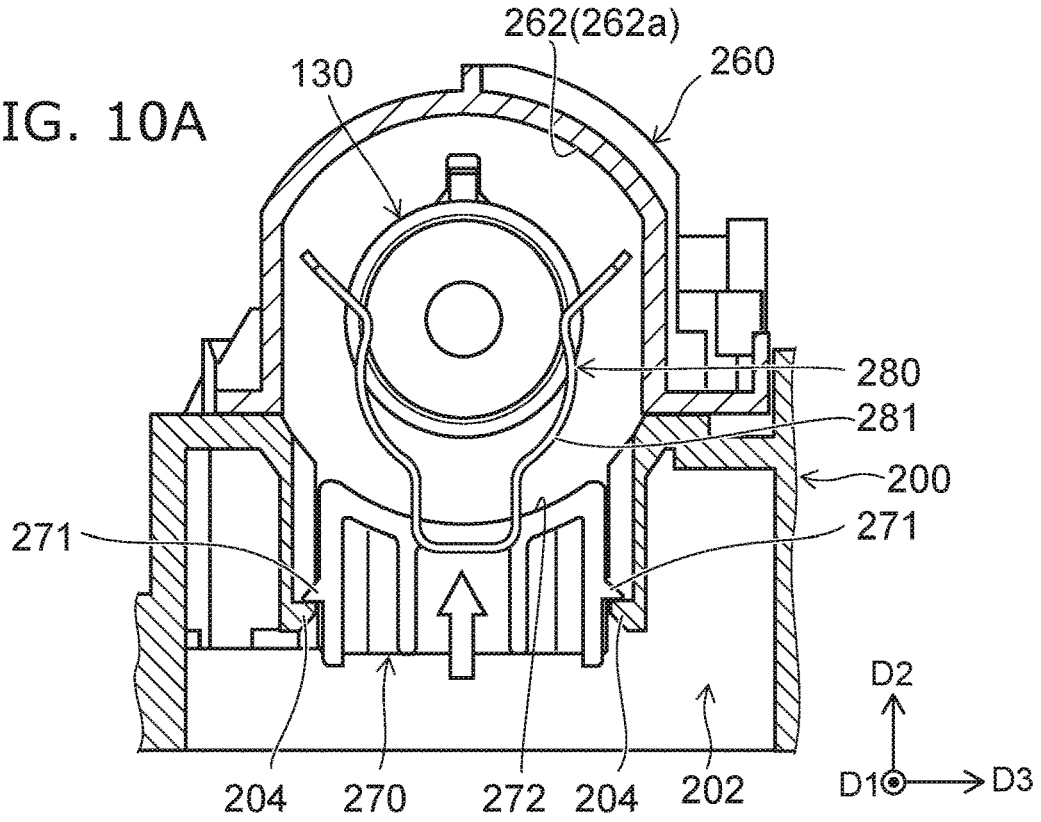
FIGS. 10A and 10B are cross-sectional views schematically showing a part of the sanitary washing device according to the embodiment of the invention.
Figure 10B:
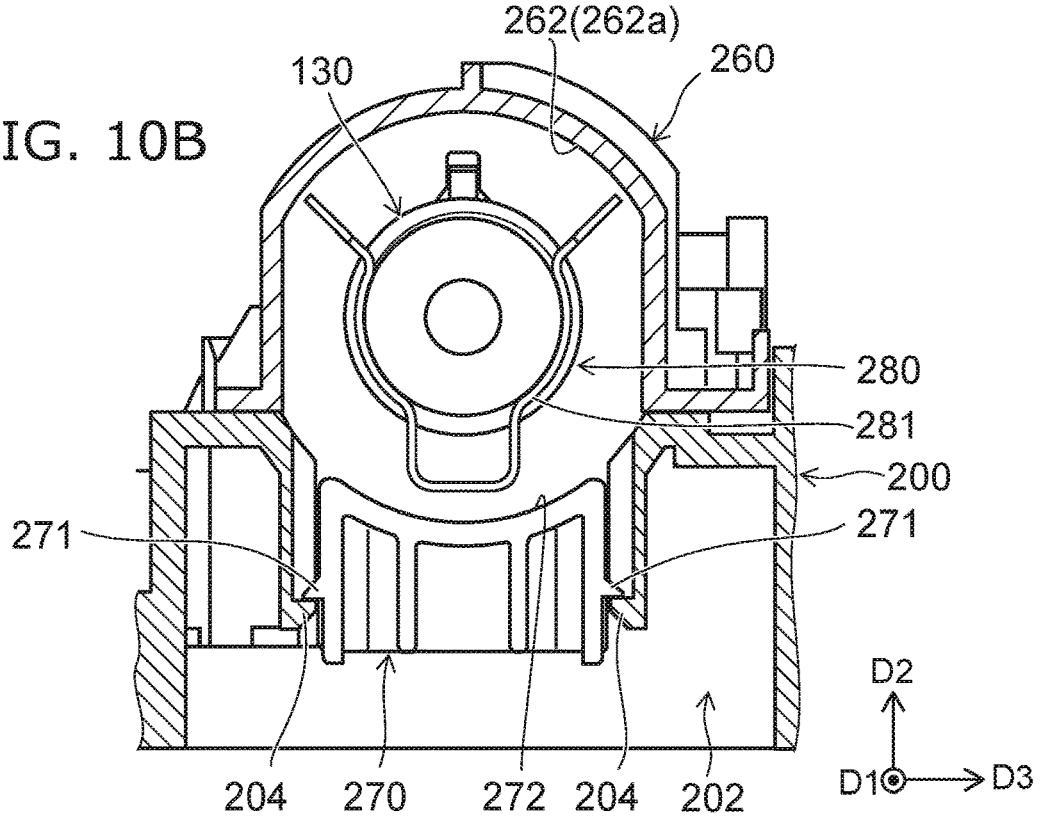

FIGS. 10A and 10B are cross-sectional views schematically showing a part of the sanitary washing device according to the embodiment of the invention.

As shown in FIGS. 10A and 10B, the lower cover 270 includes a pair of engaging parts 271 provided on both the left and right sides. A pair of engaged parts 204 that engage with the engaging parts 271 of the lower cover 270 is provided in the base plate 200. The lower cover 270 is detachably mounted on the base plate 200 and is disposed at a position accessible from below by engaging the engaging parts 271 with the engaged parts 204. For example, the lower cover 270 may be mounted on the base plate 200 by screw retention, etc. The method for mounting the lower cover 270 may be arbitrary.

The lower cover 270 has a facing surface 272 that faces the retaining member 280 when the lower cover 270 is mounted on the base plate 200. As shown in FIG. 10A, when the opening end 280*a* faces upward, the facing surface 272 of the lower cover 270 comes into contact with the retaining member 280 and moves the retaining member 280 toward the appropriate position when the clamping parts 281 clamp the water supply connection unit 250 and the water supply pipe 112 at a position lower than the appropriate position as shown in FIG. 10B. Thereby, by mounting the lower cover 270, the half-inserted state of the retaining member 280 is eliminated; and the retaining member 280 can be mounted appropriately to the water supply connection unit 250 and the water supply pipe 112.

The base plate 200 and the lower cover 270 allow the retaining member 280 to rotate with the cylindrical parts 251 and 113*e* as an axis. Thereby, when the upper cover 260 is detached, the direction in which the retaining member 280 is detached can be changed by rotationally moving the retaining member 280.

The upper cover 260 has a facing surface 262*a* that faces the retaining member 280 in the second direction D2 when the upper cover 260 is mounted on the base plate 200. When the opening end 280*a* faces downward, the facing surface 262*a* of the upper cover 260 comes into contact with the retaining member 280 and moves the retaining member 280 toward the appropriate position when the clamping parts 281 clamp the water supply connection unit 250 and the water supply pipe 112 at a position higher than the appropriate position. Thereby, in the case where the retaining member 280 is mounted from above, the half-inserted state of the retaining member 280 can be eliminated by mounting the upper cover 260.

Figure 11:
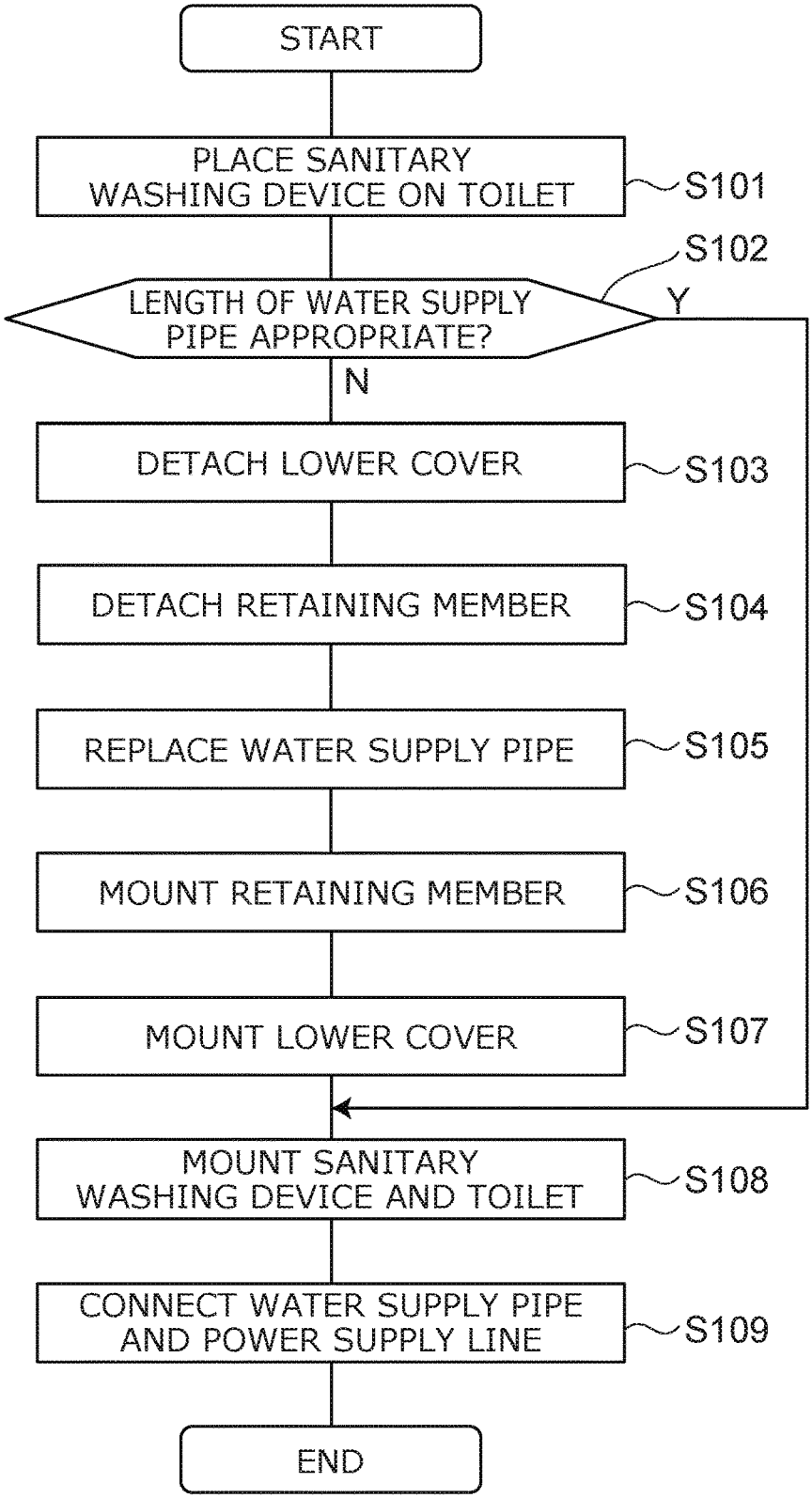
FIG. 11 is a flowchart schematically showing an example of the method for mounting the toilet apparatus according to the embodiment of the invention.

FIG. 11 is a flowchart schematically showing an example of the method for mounting the toilet apparatus according to the embodiment of the invention.

In the case where the toilet apparatus 10 is mounted in a toilet space, first, the toilet 50 is temporarily placed at the prescribed position in the toilet space; and the sanitary washing device 100 is placed on the upper surface 50*a* of the toilet 50 (step S101 of FIG. 11).

For example, the toilet apparatus 10 is shipped from the manufacturer in a state in which the water supply pipe 112 of a prescribed length is connected to the sanitary washing device 100. In such a case, the operator determines whether or not the length of the water supply pipe 112 is appropriate after placing the sanitary washing device 100 on the toilet 50 (step S102 of FIG. 11).

In the case where the operator determines that the length of the water supply pipe 112 is inappropriate, first, the lower cover 270 is detached from below through the opening 202 provided in the base plate 200 of the casing 110 (step S103 of FIG. 11).

The toilet apparatus 10 is shipped in the state in which the opening end 280*a* of the retaining member 280 faces upward. Accordingly, when the lower cover 270 is detached, the connection unit 282 of the retaining member 280 is exposed downward. The operator detaches the retaining member 280 from the water supply connection unit 250 and the water supply pipe 112 by inserting a tool or the like into the gap between the water supply connection unit 250 and the connection unit 282 and by pulling off the retaining member 280 downward (step S104 of FIG. 11).

After the retaining member 280 is detached, the connected water supply pipe 112 is detached by pulling out the insertion part 113*a* of the connection pipe 113 from the connection port 252 of the water supply connection unit 250. Then, the water supply pipe 112 is replaced with a water supply pipe 112 of the appropriate length by passing a new water supply pipe 112 through the opening 202 and by inserting the insertion part 113*a* into the connection port 252 (step S105 of FIG. 11).

Thus, in the sanitary washing device 100, the attachment and removal of the water supply pipe 112 can be performed from below before being mounted on the toilet 50. Also, the connection pipe 113 that is bent into a substantially L-shaped configuration is provided at one end of the water supply pipe 112; and the insertion part 113*a* is provided in the connection pipe 113. Thereby, it is easy to detach and insert the insertion part 113*a* from and into the connection port 252 facing the direction orthogonal to the vertical direction when performing the attachment and removal of the water supply pipe 112 from below.

After the new water supply pipe 112 is connected to the connection port 252, the retaining member 280 is mounted on the water supply connection unit 250 and the water supply pipe 112 by inserting the retaining member 280 onto the water supply connection unit 250 and the water supply pipe 112 from below (step S106 of FIG. 11).

At this time, the guide part 262 of the upper cover 260 causes the retaining member 280 to be disposed at the predetermined position and in the predetermined direction. Thereby, the mistaken mounting of the retaining member 280 can be suppressed. For example, the retaining member 280 can be mounted appropriately to the water supply connection unit 250 and the water supply pipe 112 even if the operator is inexperienced.

After the retaining member 280 is mounted, the lower cover 270 is mounted on the base plate 200 by engaging the engaging parts 271 of the lower cover 270 with the engaged parts 204 of the base plate 200 (step S107 of FIG. 11).

At this time, if the clamping parts 281 of the retaining member 280 clamp the water supply connection unit 250 and the water supply pipe 112 at a position lower than the appropriate position, the facing surface 272 of the lower cover 270 comes into contact with the retaining member 280 and moves the retaining member 280 toward the appropriate position. Thereby, the half-inserted state of the retaining member 280 can be eliminated. For example, the retaining member 280 can be mounted appropriately to the water supply connection unit 250 and the water supply pipe 112 even if the operator is inexperienced.

After the water supply pipe 112 is replaced and the retaining member 280 and the lower cover 270 are mounted, the water supply pipe 112 and the power supply line 114 are inserted through the opening 58 of the toilet 50; and the water supply pipe 112 and the power supply line 114 are drawn out from the recess 53 of the toilet 50. Subsequently, the sanitary washing device 100 is mounted on the toilet 50 via the mounting holes 56 of the toilet 50. Then, the toilet 50 is fixed by mounting the toilet 50 to the floor surface of the toilet space, etc. (step S108 of FIG. 11).

In the case where it is determined in step S102 that the length of the water supply pipe 112 is appropriate, the flow proceeds to step S108; and the mounting of the sanitary washing device 100 and the mounting of the toilet 50 are performed. For example, the mounting of the sanitary washing device 100 to the toilet 50 may be performed after the toilet 50 is mounted on the floor surface, etc.

After the mounting of the sanitary washing device 100 and the toilet 50, the water supply pipe 112 and the power supply line 114 are drawn out from the gap between the wall surface WL and the rear end part 50*c* of the toilet 50. Then, the water supply pipe 112 is connected to the water supply source; and the power supply line 114 is connected to the electrical power supply source (step S109 of FIG. 11). Thus, the mounting of the toilet apparatus 10 is completed.

In the toilet apparatus 10, the water/power supply unit is concealed by the casing 110. The opening 202 for drawing out the water supply pipe 112 and the power supply line 114 from the casing 110 are concealed by the toilet 50. The recess 53 of the toilet 50 is covered with the side surface part 52 and is not exposed at the front and two sides. Thereby, in the toilet apparatus 10, high design quality can be obtained. For example, the water supply pipe 112 and the power supply line 114 can be less noticeable.

The case is shown in the example recited above where the sanitary washing device 100 is shipped from the manufacturer in the state in which the water supply pipe 112 of the prescribed length is connected to the sanitary washing device 100. The sanitary washing device 100 may be shipped in the state in which the water supply pipe 112 is detached from the sanitary washing device 100. In such a case, the lower cover 270 is detached and the water supply pipe 112 of the appropriate length is connected in the operation of mounting the toilet apparatus 10; then, a method similar to step S106 and the subsequent steps recited above may be performed.

Figure 12:
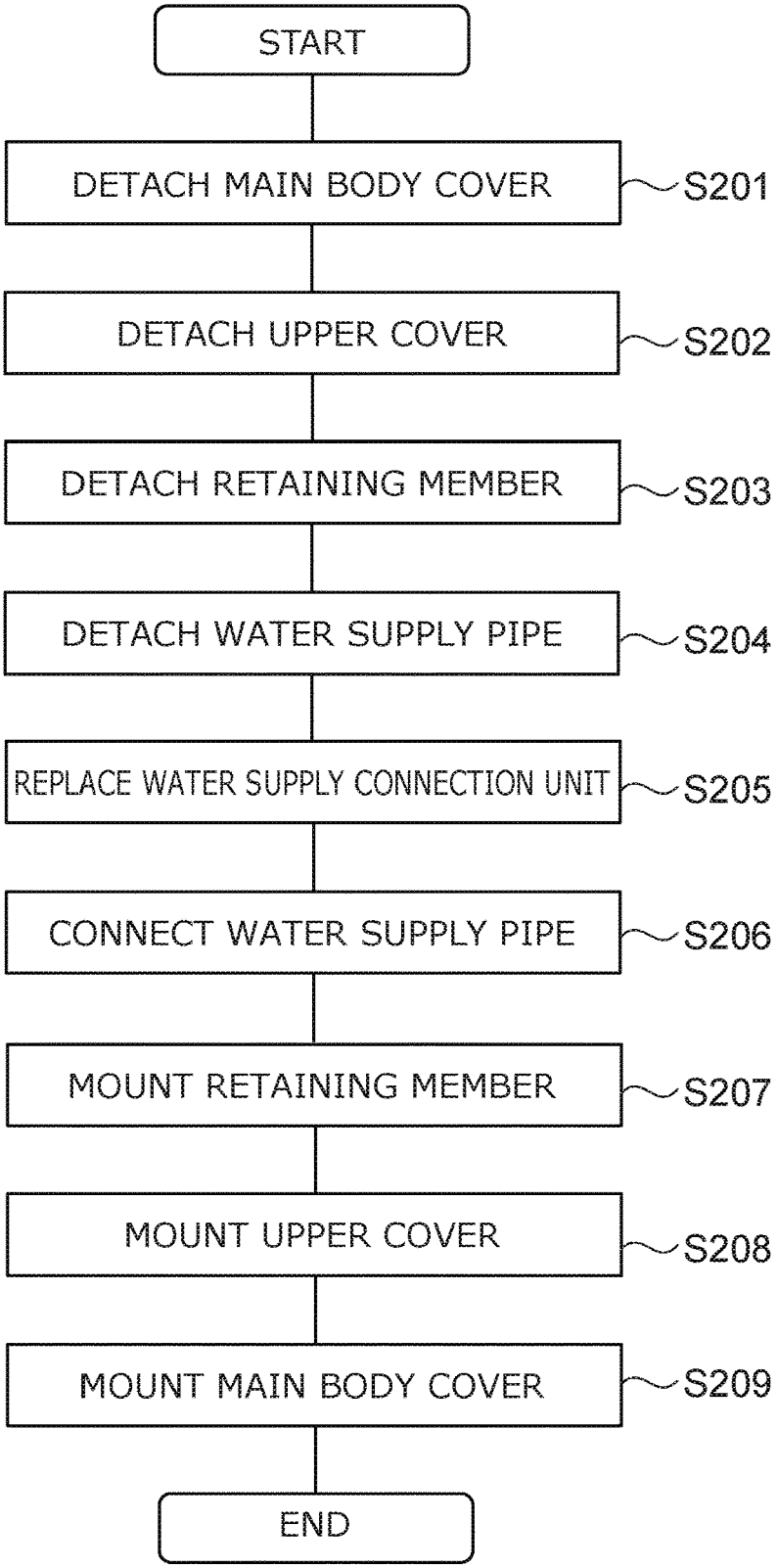
FIG. 12 is a flowchart schematically showing an example of a maintenance operation of the toilet apparatus according to the embodiment of the invention.

FIG. 12 is a flowchart schematically showing an example of a maintenance operation of the toilet apparatus according to the embodiment of the invention.

FIG. 12 schematically shows an example of the operation in the case where the water supply connection unit 250 is replaced in the state in which the sanitary washing device 100 is mounted on the toilet 50. In the toilet apparatus 10, for example, there are cases where the water supply connection unit 250 is undesirably damaged due to freezing, etc. In such a case, first, the main body cover 210 is detached from the base plate 200 (step S201 of FIG. 12).

After the main body cover 210 is detached, the upper cover 260 is detached from the base plate 200 (step S202 of FIG. 12). Thereby, as shown in FIG. 5B, etc., the water supply connection unit 250 is exposed upward in a state in which it is possible to attach and remove the water supply connection unit 250 and the water supply pipe 112.

As described above, when shipping and in the operation of mounting in the toilet space, the retaining member 280 is mounted from below and is mounted on the water supply connection unit 250 and the water supply pipe 112 in the state in which the opening end 280*a* faces upward. Accordingly, if the upper cover 260 is detached, the opening end 280*a* of the retaining member 280 may be exposed upward. In such a case, the retaining member 280 is rotated with the cylindrical parts 251 and 113*e* as an axis to expose the connection unit 282 side of the retaining member 280 upward. Subsequently, by pulling off the retaining member 280 upward, the retaining member 280 is detached from the water supply connection unit 250 and the water supply pipe 112 (step S203 of FIG. 12).

After the retaining member 280 is detached, the water supply pipe 112 is detached by pulling out the insertion part 113*a* of the connection pipe 113 from the connection port 252 of the water supply connection unit 250 (step S204 of FIG. 12). Accordingly, in the toilet apparatus 10 and the sanitary washing device 100, for example, the water supply pipe 112 also can be replaced by pulling out the water supply pipe 112 and by inserting another water supply pipe 112 through the openings 58 and 202 and the recess 53.

After the water supply pipe 112 is detached, the connection between the body washing function unit 220 and the connection port 254 of the water supply connection unit 250 is detached; and the connection between the toilet washing function unit 230 and the connection port 256 of the water supply connection unit 250 is detached. Subsequently, the water supply connection unit 250 is detached and replaced with a new water supply connection unit 250 (step S205 of FIG. 12).

After the water supply connection unit 250 is replaced, the insertion part 113*a* of the water supply pipe 112 is inserted into the connection port 252; and the water supply pipe 112 is connected to the water supply connection unit 250 (step S206 of FIG. 12).

After the water supply pipe 112 is connected to the connection port 252, the retaining member 280 is mounted on the water supply connection unit 250 and the water supply pipe 112 by inserting the retaining member 280 onto the water supply connection unit 250 and the water supply pipe 112 from above (step S207 of FIG. 12).

After the retaining member 280 is mounted, the upper cover 260 is mounted on the water supply connection unit 250, the retaining member 280, etc. (step S208 of FIG. 12). At this time, if the clamping parts 281 of the retaining member 280 clamp the water supply connection unit 250 and the water supply pipe 112 at a position higher than the appropriate position, the facing surface 262*a* of the upper cover 260 comes into contact with the retaining member 280 and moves the retaining member 280 toward the appropriate position. Thereby, the half-inserted state of the retaining member 280 can be eliminated. For example, the retaining member 280 can be mounted appropriately to the water supply connection unit 250 and the water supply pipe 112 even if the operator is inexperienced.

After the upper cover 260 is mounted, the main body cover 210 is mounted on the base plate 200 (step S209 of FIG. 12). Thus, the operation of replacing the water supply connection unit 250 is completed.

For example, in the case where the water supply connection unit 250 is provided at the bottom surface 110*a* of the casing 110 (in the case where the connection port 252 is positioned lower than the base plate 200) and if the water supply connection unit 250 is undesirably concealed by the casing 110 and the toilet 50, the water supply pipe 112 unfortunately cannot be detached from the water supply connection unit 250 after the sanitary washing device 100 is mounted on the toilet 50 without first detaching the sanitary washing device 100 from the toilet 50. In other words, the replacement of the water supply pipe 112 and/or the water supply connection unit 250 is undesirably difficult.

In particular, in the case where the rear end part 50*c* of the toilet 50 is disposed proximally to the wall surface WL in the toilet space and the two sides and front of the upper surface 50*a* and the bottom surface 50*b* are surrounded with the side surface part 52 as in the toilet 50 recited above, the sanitary washing device 100 cannot be detached from the toilet 50 without detaching the toilet 50 itself from the floor surface, etc., and shifting the toilet 50 frontward. Therefore, the operation undesirably becomes large-scale.

Conversely, in the toilet apparatus 10 and the sanitary washing device 100 according to the embodiment, the water supply connection unit 250 and the connection port 252 are disposed inside the casing 110; the water supply pipe 112 is attached to and removed from the connection port 252 from below through the opening 202; and when the main body cover 210 is detached, the water supply pipe 112 can be attached to and removed from the connection port 252 from above.

Thereby, in the toilet apparatus 10 and the sanitary washing device 100, even in the case where the water/power supply unit is concealed, it is unnecessary to detach the toilet 50 and the sanitary washing device 100 themselves; and the replacement of the water supply pipe 112, the water supply connection unit 250, etc., can be performed by merely detaching the main body cover 210. Accordingly, in the toilet apparatus 10 and the sanitary washing device 100, the decrease of the ease of maintenance in the case where the water/power supply unit is concealed can be suppressed.

The embodiments of the invention have been described above. However, the invention is not limited to the above description. Those skilled in the art can appropriately modify the design of the above embodiments. Such modifications are also encompassed within the scope of the invention as long as they include the features of the invention. For instance, the shape, dimension, material, and placement of each element of the toilet apparatus 10 and the sanitary washing device 100 are not limited to those illustrated above, but can be appropriately modified.

Furthermore, the elements of the above embodiments can be combined with each other as long as technically feasible. Such combinations are also encompassed within the scope of the invention as long as they include the features of the invention.

What is claimed is:

1. A sanitary washing device, comprising:

a body washing function unit including a washing nozzle, the body washing function unit configured to wash an anogenital area of a human body by squirting washing water toward the anogenital area from the washing nozzle;

a casing including a base plate and a main body cover, the main body cover being detachably mounted on the base plate, the casing having an enclosed space defined by the base plate and the main body cover, the casing housing the body washing function unit in the enclosed space, the base plate having an opening;

a water supply connection unit provided in the enclosed space and having a connection port, the connection port being detachably connected to a first end of a water supply pipe, the water supply connection unit supplying, to the body washing function unit, the washing water supplied from the water supply pipe, the water supply pipe having an insertion part inserted into the connection port, the insertion part being provided at the first end of the water supply pipe;

an upper cover detachably mounted on the base plate, the upper cover being provided above the opening of the base plate, the upper cover covering an upper side of the connection port and the insertion part of the water supply pipe; and a retaining member detachably mounted on the water supply connection unit and the water supply pipe, the retaining member being configured to suppress the insertion part from detaching from the connection port, the connection port being disposed in the enclosed space, the casing being configured such that the first end of the water supply pipe can be attached to and detached from the connection port without moving the sanitary washing device, the connection port being disposed at a position accessible through the opening, the connection port being disposed at a position accessible from above when the main body cover is detached, the opening of the base plate being provided above an opening of a toilet when the base plate is mounted on the toilet, the toilet having an upper surface, the opening of the toilet being provided in the upper surface of the toilet, the base plate being configured such that the water supply pipe enters the enclosed space through the opening of the base plate and the opening of the toilet, the opening of the base plate and the opening of the toilet being configured such that the first end of the water supply pipe is capable of being pulled out from the enclosed space and is capable of being inserted into the enclosed space while the base plate remains mounted on the toilet, and the upper cover having a guide part, the guide part allowing the retaining member to be mounted on the water supply connection unit and the water supply pipe when attaching the retaining member to the water supply connection unit and the water supply pipe from below at a predetermined position, the guide part inhibiting the retaining member from being mounted on the water supply connection unit and the water supply pipe when attaching the retaining member to the water supply connection unit and the water supply pipe from below at a position different from the predetermined position.

2. The sanitary washing device according to claim 1, wherein the retaining member has a pair of clamping parts clamping the water supply connection unit and the water supply pipe.

3. The sanitary washing device according to claim 2, wherein:

the water supply connection unit has a first cylindrical part and a first flange part, the first flange part has the connection port at an end of the first flange part, the first flange part is adjacent to the end of the first cylindrical part, an outside diameter of the first flange part being larger than an outside diameter of the first cylindrical part, the water supply pipe has a second flange part and a second cylindrical part, the second flange part is provided at a back end of the insertion part and comes into contact with the first flange part when the insertion part is inserted into the connection port, the second cylindrical part is adjacent to the second flange part, an outside diameter of the second cylindrical part being smaller than an outside diameter of the second flange part, at least a part of the retaining member has elasticity, the retaining member being configured such that elastic deformation of the retaining member allows the pair of clamping parts to move closer to or away from each other, and the guide part allows the retaining member to be mounted on the water supply connection unit and the water supply pipe in a first state which is a state in which the pair of clamping parts clamps the first cylindrical part and the second cylindrical part, while the guide part does not allow the retaining member to be mounted on the water supply connection unit and the water supply pipe in a second state which is a state in which the pair of clamping parts clamps the first flange part and the second flange part such that a distance between the clamping parts in the second state is wider than a distance between the clamping parts in the first state.

4. The sanitary washing device according to claim 1, further comprising:

a lower cover being detachably mounted on the base plate, and covering a part of the opening, the lower cover being disposed at a position accessible from below; and the retaining member having a pair of clamping parts clamping the water supply connection unit and the water supply pipe, the water supply connection unit having the connection port above the part of the opening, the retaining member being configured to suppress the insertion part from detaching from the connection port, and the lower cover having a facing surface facing the retaining member when the lower cover is mounted on the base plate, the lower cover coming into contact with the retaining member and moving the retaining member toward an appropriate position when the pair of clamping parts clamps the water supply connection unit and the water supply pipe at a position lower than the appropriate position.

5. A toilet apparatus, comprising:

a toilet having an upper surface and an opening, the opening of the toilet being provided in the upper surface of the toilet; and a sanitary washing device provided on the upper surface of the toilet, the sanitary washing device including:

a body washing function unit including a washing nozzle, the body washing function unit configured to wash an anogenital area of a human body by squirting washing water toward the anogenital area from the washing nozzle;

a casing including a base plate and a main body cover, the main body cover being detachably mounted on the base plate, the casing having an enclosed space defined by the base plate and the main body cover, the casing housing the body washing function unit in the enclosed space, the base plate having an opening;

a water supply connection unit provided in the enclosed space and having a connection port, the connection port being detachably connected to a first end of a water supply pipe, the water supply connection unit supplying, to the body washing function unit, the washing water supplied from the water supply pipe, the water supply pipe having an insertion part inserted into the connection port, the insertion part being provided at the first end of the water supply pipe;

an upper cover being detachably mounted on the base plate, the upper cover being provided above the opening of the base plate, the upper cover covering an upper side of the connection port and the insertion part of the water supply pipe; and a retaining member detachably mounted on the water supply connection unit and the water supply pipe, the retaining member being configured to suppress the insertion part from detaching from the connection port, the base plate having a bottom surface facing the upper surface, the connection port being disposed in the enclosed space, the casing being configured such that the first end of the water supply pipe can be attached to and detached from the connection port without moving the sanitary washing device, the connection port being disposed at a position accessible through the opening, the connection port being disposed at a position accessible from above when the main body cover is detached, the toilet having the upper surface disposed under the entire bottom surface of the base plate, the opening of the base plate being provided above the opening of the toilet when the base plate is mounted on the toilet, the base plate being configured such that the water supply pipe enters the enclosed space through the opening of the base plate and the opening of the toilet, the opening of the base plate and the opening of the toilet being configured such that the first end of the water supply pipe is capable of being pulled out from the enclosed space and is capable of being inserted into the enclosed space while the base plate remains mounted on the toilet, and the upper cover having a guide part, the guide part allowing the retaining member to be mounted on the water supply connection unit and the water supply pipe when attaching the retaining member to the water supply connection unit and the water supply pipe from below at a predetermined position, the guide part inhibiting the retaining member from being mounted on the water supply connection unit and the water supply pipe when attaching the retaining member to the water supply connection unit and the water supply pipe from below at a position different from the predetermined position.

* * * * *